United States Patent [19]

Inoue et al.

[11] Patent Number: 4,978,603

[45] Date of Patent: Dec. 18, 1990

[54] IMAGE FORMING PROCESS COMPRISING DEVELOPING FINE GRAIN SILVER HALIDE EMULSION WITH A HYDROQUINONE DEVELOPER

[75] Inventors: Nobuaki Inoue; Morio Yagihara; Yoshihiro Takagi, all of Kanagawa, Japan

[73] Assignee: Fuji Photo Film Co., Ltd., Kanagawa, Japan

[21] Appl. No.: 284,080

[22] Filed: Dec. 14, 1988

[30] Foreign Application Priority Data

Dec. 14, 1987 [JP] Japan ..... 62-315768
Dec. 18, 1987 [JP] Japan ..... 62-320705

[51] Int. Cl.[5] ..... G03C 5/24; G03C 1/54

[52] U.S. Cl. ..... 430/265; 430/267; 430/434; 430/438; 430/440; 430/446; 430/464; 430/481; 430/567; 430/568; 430/605; 430/611; 430/613; 430/948; 430/949

[58] Field of Search ..... 430/434, 464, 438, 440, 430/489, 483, 481, 480, 600, 603, 611, 613, 948, 265, 267, 446, 567, 568, 605, 949, 378, 940

[56] References Cited

U.S. PATENT DOCUMENTS

| | | | |
|---|---|---|---|
| 4,108,661 | 8/1978 | Vanassche et al. | 430/407 |
| 4,168,977 | 9/1979 | Takada et al. | 430/568 |
| 4,210,715 | 7/1980 | Fujiwhara et al. | 430/568 |
| 4,224,401 | 9/1980 | Takada et al. | 430/440 |
| 4,311,781 | 1/1982 | Mifune et al. | 430/440 |
| 4,452,882 | 6/1984 | Akimura et al. | 430/441 |

FOREIGN PATENT DOCUMENTS

| | | | |
|---|---|---|---|
| 2360638 | 6/1974 | Fed. Rep. of Germany | 430/440 |
| 2134271 | 8/1984 | United Kingdom | 430/440 |

OTHER PUBLICATIONS

Derwent Abstract, J-60-095538-A, 5/85, Saeki et al., "Fast Photographic Process . . . ".
Derwent Abstract J-60-095538-A, 5/85, Saeki et al., "Fast Photographic Process . . . ".
Derwent Abstract, EP-71344-A, 2/83, P. Wuelfing, "Photographic Developer . . . ".

*Primary Examiner*—Richard L. Schilling
*Assistant Examiner*—Patrick A. Doody
*Attorney, Agent, or Firm*—Sughrue, Mion, Zinn, Macpeak & Seas

[57] ABSTRACT

An image-forming process which comprises after imagewise exposing a silver halide photographic material having at least one silver halide emulsion layer composed of silver halide grains containing at least $1\times10^{-6}$ mol of a rhodium salt per mol of silver and having a mean grain size of not larger than 0.15 μm with a developer meeting the following conditions (a) to (d);

(a) the developer substantially contains dihydroxybenzene only as the developing agent,
(b) the developer contains at least 0.18 mol/liter of a free sulfite,
(c) pH thereof is at least 10.5, and
(d) the developer contains at least 20 mg/liter of a compound represented by formula (I):

(I)

wherein $X_1$ represents a hydrogen atom or a nitro group and $X_2$ and $X_3$ each represents a hydrogen atom or an alkyl group having from 1 to 4 carbon atoms.

14 Claims, 1 Drawing Sheet

FIGURE
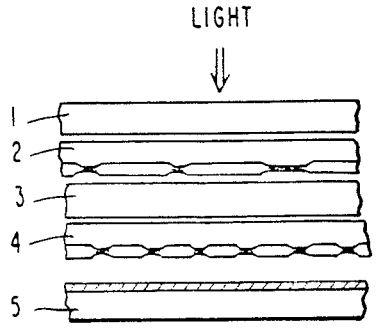

IMAGE FORMING PROCESS COMPRISING DEVELOPING FINE GRAIN SILVER HALIDE EMULSION WITH A HYDROQUINONE DEVELOPER

FIELD OF THE INVENTION

This invention relates to a silver halide photographic material and a process for developing the photographic light-sensitive material. More particularly, the invention relates to a silver halide photographic material which can be handled under an environment capable of calling substantial bright room (hereafter referred to as "bright room-type") and a process for developing the silver halide photographic material.

BACKGROUND OF THE INVENTION

In the process of making printing plates, from the requirement of performing a contact exposure step (so-called contact work or duplicate work) using a relatively low speed light-sensitive material in a bright room, a photographic light-sensitive material which can be handled under an environment which can be considered a substantial bright room while using silver halide as the photosensitive element has been provided. This is attained by light-exposing a light-sensitive material having a reduced sensitivity to visible light under a safelight containing substantially no ultraviolet light, to a light source having wavelengths of less than 420 nm.

On the other hand, for the so-called contact work, not only a simple one sheet contact duplicate (i.e., a light-sensitive material for a duplicate is exposed in contact with one sheet of processed photographic film and developed to performed nega-posi image conversion) but also a high image conversion work, the so-called white lettering on a solid background, are performed. The term "white lettering on a solid background" means non-inked portions of letters, marks, etc., in the portions having ink dot-like on a paper (dot portions) and the portions having an ink overall on the paper (called solid black portions) in a print. More practically, a method of making white lettering on solid background in a photomechanical process is explained by referring to the accompanying drawing. That is, as shown in FIG. 1, a transparent or translucent film base 3 (usually, a polyethylene terephthalate film having a thickness of a few hundred μm is used) having attached thereto a processed photographic film 4 with dot images (dot original) is superposed with a similar film base 1 having attached thereto a processed photographic film 2 having the so-called line positive images such as letters, marks, etc., formed thereon (line image original), the assembly as an original is superposed on a light-sensitive material 5 for duplication such that the dot image portion is in close contact with the surface of the silver halide emulsion layer of the light-sensitive material 5, and the light-sensitive material is exposed and processed to form white line image portions in the dot images. In the above-described process, it is important that dot images and line images perform nega/posi conversion in conformity with the dot area and the line width, respectively. For example, a dot image having a black area of 50% must be accurately converted into a white area of 50% and a line image having a back line width of 50 μm into a white line width of 50 μm.

However, as is clear by FIG. 1, the dot images are in direct contact with the emulsion surface of the light-sensitive material 3 for duplication on light exposure but the line images are exposed onto the light-sensitive material for duplication through the dot image original 4 (usually having a thickness of about 110 μm) and the film base 3 (having a thickness of few hundreds μm) for the dot images. That is, the line images are printed onto the light-sensitive material for duplication as blurred images through transparent or translucent spaces having few hundreds μm thick. Thus, if an ordinary exposure amount (an exposure amount capable of faithfully performing the nega/posi conversion of dot images) is employed, the white line width of the line image is thinned due to the influence of the blurring exposure. On the other hand, if the exposure amount is decreased to reduce the influence of the blurring exposure to faithfully perform the nega/posi conversion of the line width of the line image, the dot area is thinned due to a lack of exposure. These phenomena are greatly influenced not only by the light-sensitive material but also by the light source for the light exposure. In other words, if the light source for exposure is small such as a point light source, the extent of the aforesaid blurring exposure is reduced. However, in the bright-room type light-sensitive material as used in this invention, an exposure device of a large light quality must be used and hence the light source is larger than that of a conventional bright room-type exposure device. This results in causing a deterioration of the quality of white lettering on solid background.

A means for preventing the occurence of such a deterioration of the white lettering on a solid background is described in JP-A-58-190943. (The term "JP-A" as used herein means an "unexamined published Japanese patent application"). However, in the case of using a light-sensitive material with a silver halide of the grain sizes described in the examples of the aforesaid JP-A application, there is the problem that the quality of white lettering on a solid background is reduced by scattering of light on the silver halide grains in the emulsion layer and hence a silver halide emulsion of fine grain sizes giving less scattering of light has been required.

Also, in order that a light-sensitive material can be allowed to stand for a long period of time under a safe fluorescent lamp, the content of silver bromide in the silver halide emulsion for the light-sensitive material must be reduced but since in such silver halide grains, the solubility is increased as the grain sizes thereof are reduced, a method of stably preparing such silver halide grains has not yet been found.

That is, since silver halide grains mainly composed of silver chloride grains having a mean grain size of less than 0.15 μm have high solubility, the grain formation is performed by reducing the temperature for the grain formation or increasing the addition rates of the solutions of grain-forming components for reducing the grain sizes, but in this case, there is a problem that physical ripening proceeds during and/or after grain formation and in particular, the grain size is increased or the grain form is deformed in the desalting step (flocculation step or water washing step) and in the post-ripening step. Also, in the case of performing the grain formation at low temperature of lower than 30° C, it is difficult to control the temperature at a constant temperature for the production of the silver halide grains and hence a method for stably producing such silver halide grains has been desired.

Furthermore, in silver halide grains mainly composed of fine grain silver chloride, the grain sizes are greatly changed after the formation of grains, in a desalting step, and/or in the post-ripening step. If a compound absorbing onto the surface of silver halide grains is added as a grain growth inhibitor for preventing a change in grain sizes, the change in the grain sizes can be reduced but there is a problem of changing the crystal habit. Thus, a method of preparing such silver halide without changing the grain sizes and the crystal habit has been desired.

On the other hand, since a grain growth inhibitor is generally a compound such as an antifoggant or a stabilizer, if the inhibitor remains in a silver halide emulsion after washing with water in the case of preparing the silver halide grains in the presence thereof, a problem that the inhibitor greatly inhibits the subsequent chemical ripening by the chemical sensitizer to reduce the photographic sensitivity and Dmax to an extent that such is unsuitable for practical use and a problem of a large obstruction of the adsorption of spectral sensitizing dye(s) on the silver halide grains occur. Thus, a method of solving these problems has been keenly desired.

Also, silver chloride grains having grain sizes of less than 0.15 μm cause a problem that uneven development tends to occur at development. In particular, the occurence of uneven squeezing of rollers at the development section of an automatic processor is also a large problem. This is also considered to be caused, by the high solubility of the silver halide grains and this phenomenon severely occurs in the case of a fine grain silver chloride emulsion. Thus, a method of overcoming the difficulty has been very earnestly desired.

Also, when a primitive emulsion prepared is stored in a refrigerator for a long period of time (1 to 3 months), in silver halide grains having a mean grain size of less than 0.15 μm and composed of more than 80 mol % silver chloride, the grain sizes are increased or grains are deformed resulting in serious problems in the stability of the primitive emulsion.

Furthermore, when a primitive emulsion is dissolved and is allowed to stand as a coating solution in the dissolved state for a long period of time (2 to 10 hours), serious problems that physical ripening occurs and the grain sizes are increased or grains are deformed changing the photographic properties.

As described above, silver halide grains having a mean grain size of less than 0.15 μm and composed of more than 80 mol % silver chloride have the problems of increasing the grain sizes or changing the form of the grains due to the high solubility and hence a method of solving the problems has been keenly desired.

On the other hand, in the graphic arts field, for improving the reproduction of continuous tone images by dot images or the reproduction of line images, an image-forming system showing photographic characteristics of a super high contrast (in particular, a gamma higher than 10) is required. For the purpose, a specific developer called a lith developer has hitherto been used. A lith developer contains hydroquinone only as the developing agent, and in the lith developer, a sulfite as a precursor is used in the form of an addition product thereto with formaldehyde to greatly reduce the concentration of free sulfite ions (usually below 0.1 mol/liter) so as not to deteriorate the infectious development ability of the developer. Accordingly, there is a problem that the lith developer has a high tendency to be air-oxidized and can not be stored for over 3 days. Also, there is the disadvantage that the developing time is long. Thus, a quick and stable developing process has been keenly desired.

As a process of obtaining high contrast photographic characteristics using a stable developer, processes of using hydrazine derivatives are described in U.S. Pat. Nos. 4,224,401, 4,168,977, 4,166,742, 4,311,781, 4,272,606, 4,221,857, 4,269,929, and 4,650,746. According to the aforesaid processes, photographic characteristics of super high contrast and high sensitivity are obtained and further the stability of the developer to air oxidation is greatly improved as compared to a lith developer since a sulfite can be added at a high concentration to the developer.

However, although the aforesaid image-formig system is suitable for a high contrast system of a very high sensitivity, it is difficult to obtain a low speed light-sensitive material for a bright room, which is widely used for contact work in a printing plate making process.

A method of obtaining a low speed light-sensitive material containing hydrazine for bright room is disclosed in JP-A-60-162246 and JP-A-61-238049. In these known systems, the amount of rhodium added is less and they are insufficient in reducing the sensitivity. JP-A-60-14038 discloses a system containing a large amount of rhodium but the tone obtained in such a system is very soft. Also, Japanese Patent Application No. 62-65116 describes a silver halide photographic material providing high contrast characteristics using hydrazine having an adsorptive group for the silver halide containing more than $1\times10^{-5}$ mol of a rhodium salt, but the light-sensitive material is still insufficient in terms of the quality of white lettering on a solid background, which is important for performance as a light-sensitive material for duplication. Also, an image-forming process of processing a light-sensitive material with a developer containing substantially hydroxybenzene only as the developing agent and a large amount of sulfite is disclosed in U.S. Pat. No. 4,452,882 and JP-A-54-37732, JP-A-60-97348 and JP-A-61-47951.

SUMMARY OF THE INVENTION

A first object of this invention is to provide an image-forming process using a light-sensitive material having a good aptitude for white lettering on a solid background.

A second object of this invention is to provide an image-forming process using a light-sensitive material which can be handled in a bright room and has a good aptitude for white lettering on a solid background.

A third object of this invention is to provide an image-forming process for quickly obtaining good images of white lettering on a solid background using a stable processing solution.

A fourth object of this invention is to provide an image-forming process using a silver halide photographic material having high covering power.

A fifth object of this invention is to provide an image-forming process using a photographic light-sensitive material for a bright room utilizing the increase in contrast by a hydrazine compound.

A sixth object of this invention is to provide a process of forming high quality images by a stable developer.

The aforesaid objects of this invention are attained by an image-forming process which comprises after image-wise exposing a silver halide photographic material having at least one silver halide emulsion layer composed of silver halide grains containing at least $1\times10^{-6}$ mol of a rhodium salt per mol of silver and having a mean grain size of not larger than 0.15 μm with a developer meeting the following conditions (a) to (d);

(a) the developer substantially contains dihydroxybenzene only as the developing agent, (b) the developer contains at least 0.18 mol/liter of free sulfite, (c) the pH thereof is at least 10.5, and (d) the developer contains at least 20 mg/liter of a compound represented by formula (I):

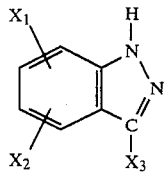

(I)

wherein $X_1$ represents a hydrogen atom or a nitro group and $X_2$ and $X_3$ each represents a hydrogen atom or an alkyl group having from 1 to 4 carbon atoms.

BRIEF DESCRIPTION OF THE DRAWING

FIG. 1 is a schematic view showing the relation of an original which is used for the work of white lettering on solid background and a light-sensitive material for duplication.

DETAILED DESCRIPTION OF THE INVENTION

The silver halide in the light-sensitive material for use in this invention has the feature that the mean grain size thereof is not larger than 0.15 μm and the effect thereof is particularly remarkable in the system of the developer for use in this invention. When the grain sizes of silver halide grains are reduced, the covering power thereof is usually increased and the effect is particularly remarkable in the developer system of this invention. Also, it has been found that when the grain sizes are reduced, the quality of white lettering on a solid background is greatly improved and the effect is particularly remarkable for silver halide grains having a grain size not larger than 0.15 μm, more particularly not larger than 0.1 μm.

There is no particular restriction on the crystal habit but a cubic form is preferred. Also, as to the halogen composition, silver halide grains of which more than 80 mol % is silver chloride are preferred. The silver halide grains are composed of more preferably more than 90 mol %, and particularly preferably more than 96% mol % silver chloride.

Thus, by reducing the grain sizes of silver halide to fine grains, the performance thereof is improved but as described hereinbefore, it has hitherto been difficult to produce silver halide grains of such a fine grain size since the solubility thereof is high and physical ripening tends to proceed at the formation of the grains or at the step of flocculating or washing the grains. In particular, with an increase of the silver chloride component, the preparation of the silver halide becomes more difficult since the solubility thereof is increased.

In this invention, the silver halide emulsion is prepared by the method described in Japanese Patent Application No. 62-133020.

In the preparation method for the fine silver halide grains having a grain size of not larger than 0.15 μm and composed of at least 80 mol % silver chloride for use in this invention, it is fundamental for forming fine grains to stabilize the nucleus particules formed at the beginning of the grain formation, that is at the formation of nuclei at the beginning of the addition of the grain-forming components and to form a large number of nucleus grains.

As the number of stable nuclei becomes larger, the silver halide formed later is deposited on these nuclei, whereby the size of the grains finally formed becomes fine.

For forming stable nuclei physical ripening at the formation of silver halide grains must be restrained to minimum, that is, it is important to prevent the nuclei formed from being re-solved.

Accordingly, the temperature for the formation of the silver halide grains is preferably as low as possible and is preferably lower than 45° C. Also, the potential at the addition of the grain-forming components is preferably in the range of +80 mV to +600 mV, and, at the formation of the nuclei, particularly preferably from +250 mV to +600 mV (reference electrode: saturated calomel electrode).

Also, the concentration of the binder is important for the stabilization of the nucleus grains and is preferably in the range of from 0.2% to 4%.

Furthermore, for forming a large number of nuclei, it is important to add solutions of a high concentration in a short period of time. For the purpose, the addition time is preferably within 30 minutes, more preferably within 20 minutes, and particularly preferably within 15 minutes.

The system for forming the silver halide grains may be stirred by any means but is preferably uniformly stirred.

The formation of the silver halide grains for use in this invention may be performed by a single jet method, a double jet method, or a combination thereof as well as a controlled double jet method.

Also, for stabilizing the nuclei, inhibiting the growth of the silver halide grains, and inhibiting the occurence of physical ripening, it is preferred to add a tetraazaindene compound to the system before, during, or after the formation of the silver halide grains. It is particularly preferred to add the compound directly after the formation of the grains. The amount of the tetraazaindene compound added is from 0.1 to 10 g, and preferably from 0.2 to 8 g, per mol of silver halide.

The pH of the system at the formation of the silver halide grains is at least 2.0, and preferably at least 4.0, for adsorbing the tetraazaindene compound onto the grains.

After the formation of the silver halide grains, a flocculation washing step (or desalting step) wherein a flocculant forming flocs by causing interaction with gelatin is added to the silver halide emulsion thus formed, the pH thereof is adjusted to the optimum value to flocculate silver halide grains and gelatin and, after removing the supernatent liquid, the emulsion is washed with water by newly adding thereto water is usually applied to the silver halide emulsion from 2 to 3 times for removing unnecessary salts.

Ordinarily, in the silver halide grains having a mean grain size of less than 0.15 μm and composed of more than 80 mol % silver chloride, physical ripening proceeds to cause an increase of the grain sizes and change of the grain form in the desalting step, whereby not only the production becomes unstable but also a necessary photographic performance is not obtained.

In particular, if the pH of the emulsion at the flocculation washing is less than 3.1, the change of the grain size and form is large. However, at other pH values than above, the change is less and further when a tetraazindene compound is added to the emulsion at a pre-ripening step, the change is far less.

That is, when the pH value in the system at the desalting step is high and a tetraazaindene compound is present in the system, not only are the grain sizes not changed but also the grains keep their form, i.e., a cubic form.

This phenomenon has not hitherto been known and is remarkable for silver halide grains having a grain size of not larger than 0.15 μm and more than 80 mol % of which is silver chloride. This is considered to be caused by the physical ripening proceeding since the solubility is reduced due to the fineness of the grain sizes and the adsorption or adsorptive power of the tetraazaindene compound or gelatin becomes weak although the details thereof must be clarified in future.

The pH of the system at the desalting step is preferably from 3.2 to 4.8, and more preferably from 3.4 to 4.8.

As gelatin which is used for preparing the silver halide emulsion for use in this invention, limed gelatin, acid-treated gelatin, phthalated gelatin, etc, may be used and a combination of these may be also used.

For removing soluble salts from the silver halide emulsion (desalting step) after the formation of the grains or after physical ripening , a flocculation method utilizing an anionic surface active agent, an anionic polymer (e.g., polystyrenesulfonic acid), or a gelatin derivative (e.g., acylated gelatin, carbamoylated gelatin, etc.) is preferably used.

The tetraazaindene compound which can be used in this invention is preferably a compound shown by following formula (II):

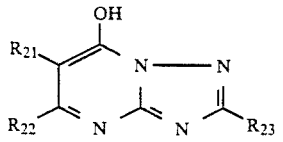

(II)

wherein $R_{21}$, $R_{22}$, and $R_{23}$ each represents a hydrogen atom, an alkyl group, an amino group, a derivative of an alkyl group, a derivative of an amino group, a halogen atom, an aryl group, a derivative of an aryl group or $-CONH-R_{24}$, wherein $R_{24}$ represents a hydrogen atom, an alkyl group, an amino group, a derivative of an alkyl group, a derivative of an amino group, a halogen atom, an aryl group, or a derivative of an aryl group.

Specific examples of tetraazaindene compounds for use in this invention are illustrated below.

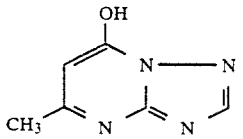

II-1

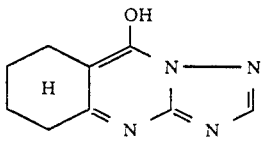

II-2

-continued

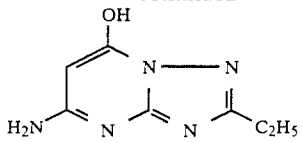

II-3

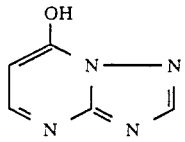

II-4

The feature of the teraazaindene compound is that the compound adsorbs on silver halide to restrain physical ripening but when the pH is reduced in a flocculation washing step, the compound is desorbed therefrom and removed from the system although partially. This means that the compound does not substantially restrain the chemical ripening by spectral sensitizers and obstruct the adsorption of sensitizing dyes. In other words, the employment of the tetraazaindene compound is an important technique for preparing fine silver halide grains having a grain size of less than 0.15 μm without substantially influencing the subsequent steps.

The term "mean grain size" is generally used in the field of silver halide photographic science and will be easily understood. When grains are spherical or near spherical, the grain size means the diameter of the grains. When the grain is cubic, the grain size is shown by the long side length ×

$$\sqrt{\frac{4}{\pi}}.$$

The mean grain size is shown by the algebraic or geometrical average based on the mean grain projected area. Details of the manner of obtaining mean grain sizes are described in C. E. Mees and T. H. James, *The Theory of the Photoqraphic Process,* 3rd Edition, pages 36 to 43 (published by McMillan, 1966).

There is no particular restriction on the grain size dispersion of the silver halide grains for use in this invention but mono-dispersed silver halide grains are preferred. Mono-dispersed grains are silver halide grains of which at least 95% by weight or number are composed of a group of silver halide grains having grain sizes within ±40%, and preferably ±20% of the mean grain size.

The silver halide grains for use in this invention preferably have a regular crystal form such as cubic and octahedral, and particularly preferably are cubic.

In this invention, a rhodium atom can be incorporated in the silver halide grains by adding as a metal salt thereof in an optional form, such as a single salt, a complex salt, etc., to the system during the preparation of the grains.

Suitable rhodium salt are rhodium monochloride, rhodium dichloride, rhodium trichloride, ammonium hexachlororhodate, etc., and preferably these salts are water-soluble halogen complex compounds of tri-valent rhodium (e.g., hexachlororhodic(III) acid and the salts thereof (ammonium salt, sodium salt, potassium salt, etc.)).

The amount of the water-soluble rhodium salt is in the range of from $1.0\times10^{-6}$ to $1.0\times10^{-3}$ mol, preferably from $1.0\times10^{-5}$ to $1.0\times10^{-3}$ mol, and particularly preferably from $5.0\times10^{-5}$ mol to $5.0\times10^{-4}$ mol per mol of silver halide.

If the amount of rhodium salt is more than $10^{-3}$ mol, it becomes impossible to sufficiently increase the contrast. While, if the amount thereof is less than $10^{-6}$ mol, a low-speed light-sensitive material suitable for bright room-use can not be obtained.

The silver halide for use in this invention is preferably a so-called core/shell type silver halide, and particularly preferably a core-shell type silver halide wherein the content of rhodium is higher in the shell than in the core.

For incorporating the aforesaid water-soluble rhodium salt into silver halide grains, a method of adding the rhodium salt to an aqueous solution of a water-soluble silver salt or an aqueous halide solution in the case of simultaneously adding the solutions to an aqueous gelatin solution is preferable. Also, an aqueous solution of the water-soluble rhodium salt may be simultaneously added with the aqueous silver salt solution and the aqueous halide solution to an aqueous gelatin solution in the case of preparing a silver halide emulsion.

In this invention, a cadmium salt, a lead salt, a thallium salt, or an iridium salt may be present in the system in addition to the aforesaid rhodium salt.

The silver halide emulsion for use in this invention may be chemically sensitized but need not be chemically sensitized.

The silver halide photographic material in this invention may contain an organic desensitizer. The organic desensitizer for use in this invention preferably has at least one water-solubilizing group or alkali-dissociative group.

The organic desensitizer for use in this invention has a positive polarographic half wave potential, that is, in the desensitizer, the sum of the polaro anodic potential and the polaro cathodic potential provided by the oxidation reduction potential determined by polarography becomes positive. The measurement of the oxidation reduction polarographic potential is described in U.S. Pat. No. 3,501,307.

Specific examples of the water-solubilizing group for the organic desensitizer are a sulfonic acid group, a carboxylic acid group, and a phosphonic acid group. These groups may form salts with an organic base (e.g., ammonia, pyridine, triethylamine, piperidine, and morpholine) or an alkali metal (e.g., sodium and potassium).

The alkali dissociative group for the organic desensitizer is a substituent which becomes anionic by a deproton reaction at the pH of a processing solution (the pH is usually in the range of from 9 to 13 but as the case may be, the processing solution may have other a pH than in the aforesaid range) or a pH lower than the pH. Examples of alkali dissociative groups are substituents having at least one hydrogen atom bonded to a nitrogen atom, such as a substituted or unsubstituted sulfamoyl group, a substituted or unsubstituted carbamoyl group, a sulfonamido group, an acylamino group, a substituted or unsubstituted ureido group, etc., and a hydroxy group.

Also, a heterocyclic group having a hydrogen atom on a nitrogen atom constituting the heterocyclic ring of a nitrogen-containing heterocyclic ring is included in the alkali dissociative group.

The water-solubilizing group or the alkali dissociative group may be bonded to any portion of the organic desensitizer and also two or more kinds of these groups may be simultaneously bonded to the desensitizer.

Specific examples of organic desensitizers which can be used in this invention are described in Japanese Patent Application No. 61-209169 and some of them are illustrated below.

OD-1

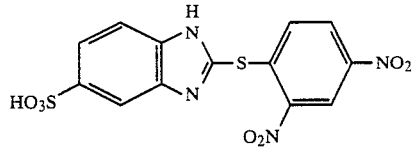

OD-2

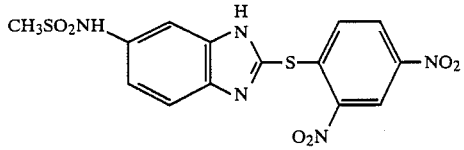

OD-3

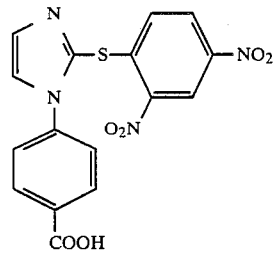

It is preferred that the organic desensitizer is present in a silver halide emulsion layer in an amount of from $1.0\times10^{-8}$ to $1.0\times10^{-4}$ mol/m$^2$, and particularly from $1.0\times10^{-7}$ to $1.0\times10^{-5}$ mol/m$^2$.

The silver halide photographic material in this invention may further contain, in the emulsion layer or other hydrophilic colloid layer, a water-soluble dye as a filter dye or for various purposes such as irradiation prevention, etc. Suitable filter dyes are dyes further lowering the photographic sensitivity, and preferably ultraviolet absorbents having a spectral absorption maximum at the intrinsic sensitivity region of the silver halide and dyes which increase the safety for a safelight in the case of handling as a light-sensitive material for bright room-use and have a substantial light absorption at the region of mainly from 350 nm to 600 nm.

Such dyes include oxonol dyes, hemioxonol dyes, styryl dyes, merocyanine dyes, cyanine dyes, and azo dyes. In these dyes, oxonol dyes, hemioxanol dyes, and merocyanine dyes are useful. Specific examples of these dyes are described in British Patents Nos. 584,609 and 1,177,429, JP-A-48-85130, JP-A-49-99620, and JP-A-49-114420, and U.S. Pat. Nos. 2,274,782, 2,533,472, 2,956,879, 3,148,187, 3,177,078, 3,247,127, 3,540,887, 3,575,704, 3,653,905, and 3,718,472.

It is preferred that the aforesaid dye is fixed with a mordant in the silver halide emulsion layer or a layer above the emulsion layer, that is, a light insensitive hydrophilic colloid layer disposed far from the emulsion layer in regard to the support.

The dye is usually incorporated in the layer in the range of from $10^{-2}$ g/m$^2$ to 1 g/m$^2$ although the amount differs from the molar extinction coefficient of the dye and is preferably from 50 mg/m$^2$ to 500 mg/m$^2$.

Specific examples of the dye are described in Japanese Patent Application No. 61-209169 and some of them are illustrated below.

Dye-1

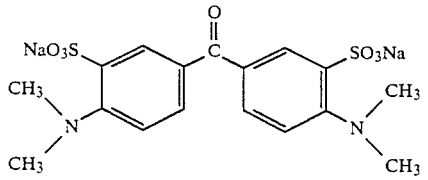

Dye-2

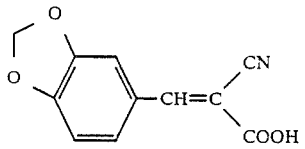

Dye-3

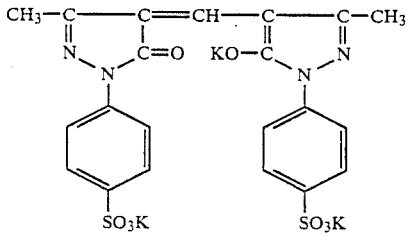

Dye-4

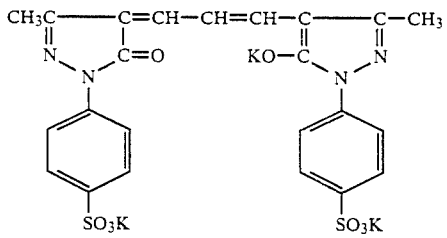

Dye-5

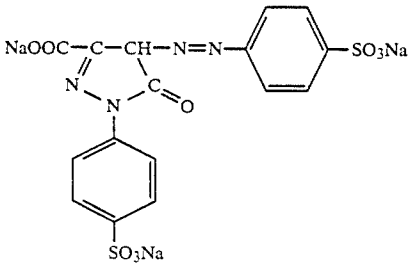

Dye-6

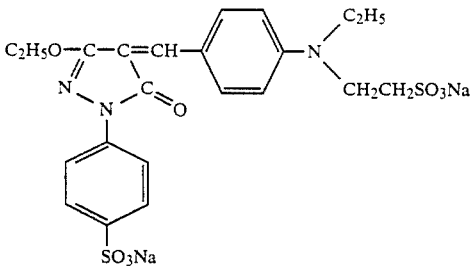

The aforesaid dye is added to a coating composition for a light insensitive hydrophilic colloid layer of the light-sensitive material which is processed in this invention as a solution in an appropriate solvent (e.g., water, an alcohol such as methanol, ethanol, propanol, etc., acetone, methyl cellosolve, and a mixture thereof).

These dyes may be used alone or as a mixture thereof.

The amount of the dye is generally from $10^{-3}$ g/m$^2$ to 1 g/m$^2$, and preferably from $10^{-3}$ g/m$^2$ to 0.5 g/m$^2$.

Also, it is preferred that a hydrazine derivative is present in the emulsion layer or another hydrophilic colloid layer of the light-sensitive material in this invention for obtaining high contrast photographic characteristics.

The hydrazine derivative for use in this invention is preferably a compound shown by formula (III)

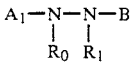

(III)

wherein $A_1$ represents an aliphatic group or an aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a . thioacyl group, a thiocarbamoyl group, a sulfamoyl group, a carbamoylcarbonyl group, an oxycarbonylcarbonyl group, or a heterocyclic group; and $R_0$ and $R_1$ both represent a hydrogen atom or one of $R_0$ and $R_1$ represents a hydrogen atom and the other represents a substituted or unsubstituted alkylsulfonyl group, a substituted or unsubstituted arylsulfonyl group, or a substituted or unsubstituted acyl group; B, $R_1$, and the nitrogen atom . bonded to them may form a partial structure,

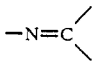

of hydrazone.

The hydrazine derivative shown by formula (III) is explained in detail below.

In formula (III), the aliphatic group shown by $A_1$ is preferably an aliphatic group having from 1 to 30 carbon atoms and is particularly a straight chain, branched or cyclic alkyl group having from 1 to 20 carbon atoms. The branched alkyl group may be cyclized so as to form a saturated heterocyclic ring containing at least one hetero atom therein. Also, the alkyl group may have a substituent such as aryl, alkoxy, sulfoxy, sulfonamido, carbonamido, etc.

Specific examples of aliphatic group for Al are t-butyl, n-octyl, t-octyl, cyclohexyl, pyrrolidyl, imidazolyl, tetrahydrofuryl, and morphalino.

The aromatic group shown by Al in formula (III) is a monocyclic or dicyclic aryl group or an unsaturated heterocyclic group. In this case, the unsaturated heterocyclic group may be condensed with a monocyclic or dicyclic aryl group to form a heteroaryl group.

Examples of suitable aromatic group are a benzene ring, a naphthalene ring, a pyridyl ring, a pyrimidine ring, an imidazole ring, a pyrazole ring, a quinoline ring, an isoquinoline ring, a benzimidazole ring, a thiazole ring, and a benzothiazole ring. Among them, rings containing a benzene ring are preferred.

$A_1$ is particularly an aryl group.

The aryl group or unsaturated heterocyclic group shown by $A_1$ may have a substituent such as, typically, a straight chain, branched or cyclic alkyl group (preferably having from 1 to 20 carbon atoms), an aralkyl group (preferably a monocyclic or dicyclic group the alkyl moiety of which has from 1 to 3 carbon atoms), an alkoxy group (preferably having from 1 to 20 carbon atoms), a substituted amino group (preferably, an amino group substituted with an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms).

$A_1$ in formula (III) may contain therein a ballast group which is usually used to immobilize photographic additives such as couplers, etc. A ballast group is a group having at least 8 carbon atoms and being relatively inactive on the photographic properties. Examples of such a ballast group are an alkyl group, an alkoxy group, a phenyl group, an alkylphenyl group, a phenoxy group, and an alkylphenoxy group.

Furthermore, $A_1$ in formula (III) may contain therein a group increasing adsorption to the surface of silver halide grains. Examples of such adsorptive groups are thiourea groups, heterocyclic thioamido groups, mercapto-heterocyclic groups, triazole groups, etc., as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-50-201049, JP-A-61-170733, JP-A-61-270744 and JP-A-62-948, Japanese Patent Application Nos. 62-67508, 62-67509, and 62-67510.

In formula (III), B represents a formyl group, an acyl group (e.g., acetyl, propionyl, trifluoroacetyl, chloroacetyl, benzoyl, 4-chlorobenzoyl, pyruvoyl group, methoxalyl group, and methyloxamoyl group), an alkylsulfonyl group (e.g., methanesulfonyl and 2-chloroethanesulfonyl), an arylsulfonyl group (e.g., benzensulfonyl), an alkylsulfinyl group (e.g., methanesulfinyl), an arylsulfinyl group (e.g., benzenesulfinyl), a carbamoyl group (e.g., methylcarbamoyl and phenylcarbamoyl), a sulfamoyl group (e.g., dimethylsulfamoyl), an alkoxycarbonyl group (e.g., methoxycarbonyl and methoxyethoxycarbonyl), an aryloxycarbonyl group (e.g., phenoxycarbonyl), a sulfinamoyl group (e.g., methylsulfinamoyl), an alkoxysulfonyl group (e.g., methoxysulfonyl and ethoxysulfonyl), a thioacyl group (e.g., methylthiocarbonyl), a thiocarbamoyl group (e.g., methylthiocarbamoyl), a sulfamoyl group (e.g., unsubstituted sulfamoyl and methylsulfamoyl), a carbamoylcarbonyl group (e.g., unsubstituted carbamoylcarbonyl), an oxycarbonylcarbonyl group (e.g., methoxycarbonylcarbonyl and phenoxycarbonylcarbonyl), or a heterocyclic group (e.g., pyridine).

B is particularly preferably a formyl group or an acyl group.

In formula (III), B and $R_1$ may form a partial structure

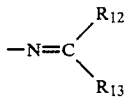

of hydrazone together with the nitrogen atom bonded thereto.

In the above formula, $R_{12}$ represents an alkyl group, an aryl group, or a heterocyclic group and $R_{13}$ represents a hydrogen, an alkyl group, an aryl group, or a heterocyclic group.

In formula (III), $R_0$ and $R_1$ each represents a hydrogen atom, an alkylsulfonyl group or arylsulfonyl group each having 20 or less carbon atoms (preferably a phenylsulfonyl group or a phenylsulfonyl group substituted such that the sum of the Hammett substituent constants becomes higher than −0.5), or an acyl group having 20 or less carbon atoms (preferably a benzoyl group, a benzoyl group substituted such that the sum of the hammett substituent constants become higher than −0.5, or a straight, branched, or cyclic unsubstituted or substituted aliphatic acyl group (examples of substituents are a halogen atom, ether, sulfonamido, carbonamido, hydroxy, carboxy, and sulfonic acid)).

$R_0$ and $R_1$ are most preferably a hydrogen atom.

Other hydrazine derivatives than the aforesaid ones, which can be also used in this invention, are described in *Research Disclosure,* No. 23516, page 346 (November, 1983) and the literature cited therein, as well as U.S. Pat. Nos. 4,080,207, 4,269,929, 4,276,364, 4,278,748, 4,385,108, 4,459,347, 4,560,638, and 4,478,928, British Patent No. 2,011,391B, JP-A-60-179734, JP-A-61-170733, JP-A-61-270744, JP-A-62-948, European Patent No. 217,310, Japanese Patent Application Nos. 61-175234, 61-251482, 61-268249, 61-276283, 62-67509, 62-67510, 62-58513, 62-130819, 62-143469, and 62-166117.

In the hydrazone derivatives shown by formula (III), a compound shown by formula (IV) is preferred.

$$R_3-SO_2NH-A_2-\overset{R_0}{\overset{|}{N}}-\overset{R_1}{\overset{|}{N}}-G_1(R_2)_n \qquad \text{(IV)}$$

wherein $G_1$ represents a carbonyl group, a sulfonyl group, a sulfoxy group, a phospho group, or an iminomethylene group; $R_2$ represents a hydrogen atom, an alkyl group, an aryl group, an alkoxy group, an aryloxy group, an amino group, a carbamoyl group, or an oxycarbonyl group; $A_2$ represents a phenylene group or a naphthylene group; $R_3$ represents an aliphatic group, an aromatic group, or a heterocyclic group; n represents 1 or 2; and $R_0$ and $R_1$ have the same significance as defined in formula (III). In the aforesaid formula, at least one of said $R_2$, $R_3$, and $A_2$ has a ballast group or a group acclerating adsorption onto silver halide.

In formula (IV), the aromatic group shown by $R_3$ is a monocyclic or dicyclic aryl group such as a phenyl group and a naphthyl group.

The aliphatic group shown by $R_3$ is a straight chain, branched, or cyclic alkyl group, an alkenyl group or an alkinyl group.

The heterocyclic group shown by $R_3$ is a 3- to 10-membered saturated or unsaturated hetefocyclic ring having at least one of N, O, and S, which may be a monocyclic ring or form a condensed ring with another heterocyclic ring or an aromatic ring.

Preferred examples of heterocyclic groups are 5- or 6-membered aromatic heterocyclic groups such as pyridine, imidazolyl, quinolynyl, benzimidazolyl, pyrimidyl, pyrazolyl, isoquinolynyl, thiazolyl, benzothiazolyl, etc.

The groups shown by $R_3$ may be substituted by the following group, which may be further substituted.

That is, examples of suitable substitutents are an alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a carboxy group, a hydroxyimino group. These groups may, if possible, combine with each other to form a ring.

When $G_1$ in formula (IV) is a carbonyl group, $R_2$ is preferably a hydrogen atom, an alkyl group (e.g., methyl, trifluoromethyl, 3-hydroxypropyl, and 3-methanesulfonamidopropyl), an aralkyl group (e.g., o-hydroxybenzyl), or an aryl group (e.g., phenyl, 3,5-dichlorophenyl, o-methanesulfonamidophenyl, and 4-methanesulfonylphenyl), and is $R_2$ particularly preferably a hydrogen atom.

Also, when $G_1$ is a sulfonyl group, $R_2$ is preferably an alkyl group (e.g., methyl}, an aralkyl group (e.g., o-hydroxyphenylmethyl), an aryl group (e.g., phenyl), or a substituted amino group (e.g., dimethylamino).

When $G_1$ is a sulfoxy group, $R_2$ is preferably a cyanobenzyl group or a methylthiobenzyl group.

When $G_1$ is a phosphoryl group, $R_2$ is preferably a methoxy group, an ethoxy group, a butoxy group, a phenoxy group, or a phenyl group, and is particularly preferably a phenoxy group.

Also, when $G_1$ is an N-substituted or unsubstituted iminomethylene group, $R_2$ is preferably a methyl group, an ethyl group, or a substituted or unsubstituted phenyl group.

Suitable substituents for the groups shown by $R_2$ are the substituents illustrated above in regard to $R_1$ as well as other substituents such as an acyl group, an acyloxy group, an alkyloxycarbonyl group, an aryloxycarbonyl group, an alkenyl group, an alkinyl group and a nitro group.

These substituent may be further substituted by these substituents. Also, if possible, these substituents may combine with each other to form a ring.

Examples of ballast groups which can be substituted onto $R_2$, $R_3$, or $A_2$ in formula (IV) are the ballast groups described above for formula (III) and in this case, the sum of the carbon atoms of the ballast group for $R_2$, $R_3$, or $A_2$ is preferably at least 13, and more preferably at least 21.

Then, the adsorption accelerating group onto silver halide, which can be substituted on $R_2$, $R_3$, or $A_2$ in formula (IV) can be shown by the formula $X_4$-(-$L_1$-)-m (wherein $X_4$ represents an adsorption accelerating group to silver halide; $L_1$ represents a divalent linkage group; and m represents 0 or 1).

Preferred examples of the adsorption accelerating group to silver halide shown by $X_4$ are a thioamido group, a mercapto group, a group having a disulfide bond, or a 5- or 6-membered nitrogen-containing heterocyclic group.

The thioamido adsorption accelerating group shown by $X_4$ is a divalent group shown by $$-\overset{\overset{\displaystyle S}{\|}}{C}\text{-amino-},$$

which may be a part of a ring or a noncyclic thioamido group. Useful thioamido adsorption accelerating groups are described, for example, in U.S. Pat. Nos. 4,030,925, 4,031,127, 4,080,207, 4,245,037, 4,255,511 4,266,013, and 4,276,364 and Research Disclosure, Nos. 15162 (November 1976) and 17626 (December 1978).

Examples of the noncyclic thioamido group are thioureido, thiourethane, and dithiocarbamic acid ester and examples of the cyclic thioamido group are 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadi-azoline-2-thione, 1,3,4-oxodiazoline-2-thione, benzimidazoline-2-thione, benzoxazoline-2-thione, and benzo-thiazoline-2-thione. These groups may be further substituted.

As the mercapto group shown by $X_4$, these are an aliphatic mercapto group, an aromatic mercapto group and a heterocyclic mercapto group (when a nitrogen atom is adjacent to the carbon atom bonded to the —SH group, the group is same as a cyclic thioamido group which is a tautomer thereof, and examples of the group are same as those illustrated above).

Examples of 5- or 6-membered nitrogen-containing heterocyclic group shown by $X_4$ are 5- or 6-membered nitrogen-containing heterocyclic rings composed of a combination of nitrogen, oxygen, sulfur, and carbon. Preferred examples thereof are benzotriazole, triazole, tetrazole, imidazole, benzimidazole, indazole, benzothiazole, thiazole, benzoxazole, oxazole, thiadiazole, oxadiazole, and triazine. They may be further substituted by suitable substituents such as the substituents described above for $R_3$.

Preferred groups shown by $X_4$ in the aforesaid group are a cyclic thioamido group, i.e., a mercaptosubstituted nitrogen-containing heterocyclic ring (e.g., 2-mercaptothiadiazole, 3-mercapto-1,2,4-triazole, 5-mercaptotetrazole, 2-mercapto-1,3,4-oxadiazole, and 2-mercaptobenzoxazole) and a nitrogen-containing heterocyclic group (e.g., benzotriazole, benzimidazole, and indazole).

Also, two or more groups shown by $X_4$-(-$L_1$-)-m described above may exist and in this case, they may be the same or different.

Specific examples of divalent linkage groups shown by $L_1$ in the aforesaid formula are an alkylene group, an alkenylene group, an alkynylene group, and an arylene group, and two or more groups may combine with each other or combine through —O—, —S—, —NH—, —N=, —CO—, —$SO_2$—(these groups may have substituents), etc., alone or as a combination thereof. Specific examples of the divalent linkage shown by $L_1$ are illustrated below.

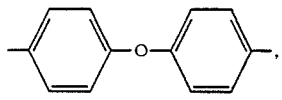

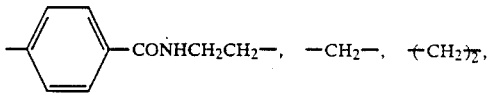

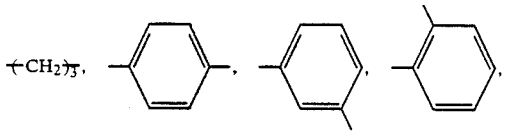

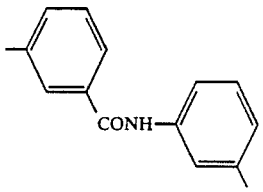

-continued

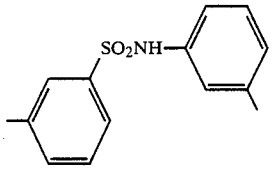

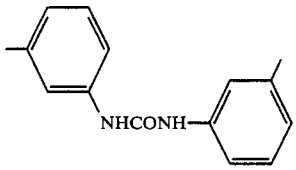

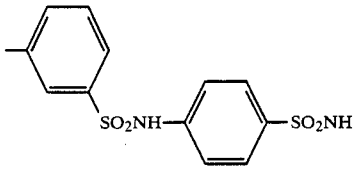

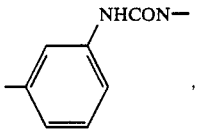

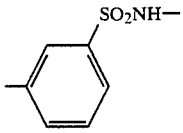

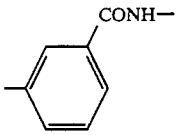

-continued $$-CH_2CH_2SO_2NH-, \quad -CH_2CH_2CONH-.$$

The aforesaid groups may be substituted by appropriate substituents such as those described above as the substituents for $R_1$.

$R_0$ and $R_1$ in the above formula have the same significance as in formula (III) and n represents 1 or 2. $R_0$ and $R_1$ are most preferably hydrogen atom and $G_1$ is most preferably a carbonyl group.

The compounds shown by formula (IV) described above are particularly preferably a compound shown by formula (V);

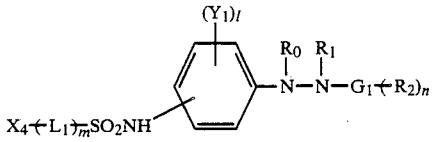

(V)

wherein $R_0$, $R_1$, $R_2$, $G_1$, $X_4$, and $L_1$ have the same significance as defined above in formulae (III) and (IV); $Y_1$ has the same significance as the substituent for $R_3$ of formula (IV); n represents 1 or 2; m represents 0 or 1; l represents 0, 1 or 2; and when l is 2, $Y_1$ is may be the same or different.

More preferably the substitution position of the group of $X\text{-}(L_1)_m SO_2NH$ in the above formula is the o-position or the p-position of the hydrazino group, and more preferably at the p-position.

Specific examples of the compound shown by formula (III) are illustrated below but the invention is not limited to them.

III-1

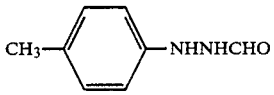

III-2

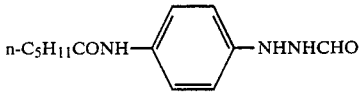

III-3

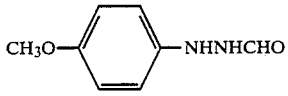

III-4

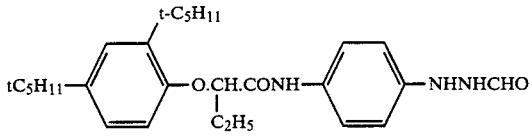

III-5

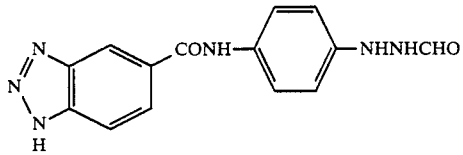

-continued
III-6
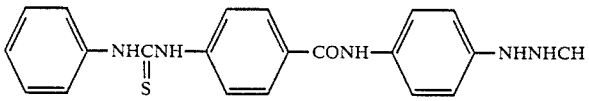
III-7
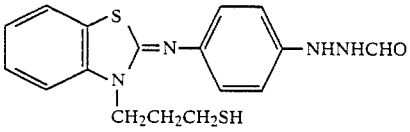
III-8
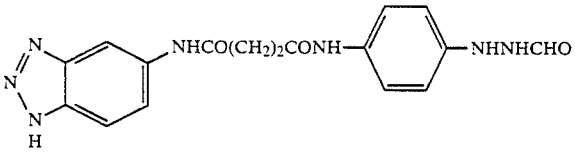
III-9
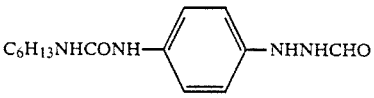
III-10
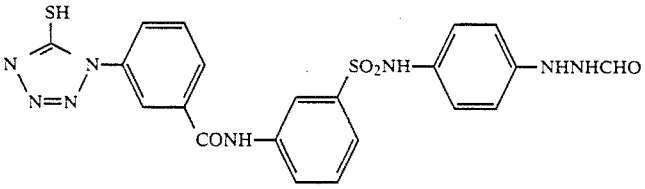
III-11
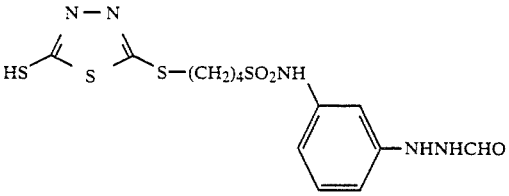
III-12
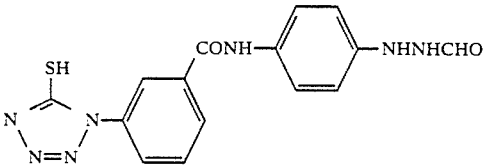
III-13
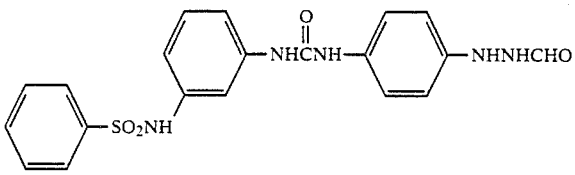
III-14
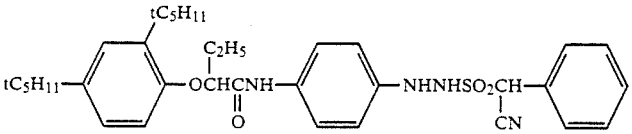
III-15
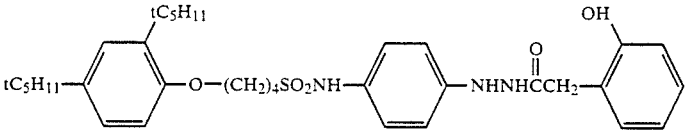

-continued
III-16
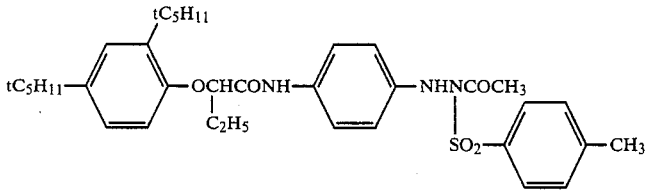
III-17
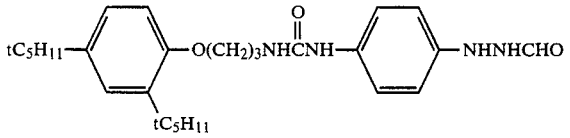
III-18
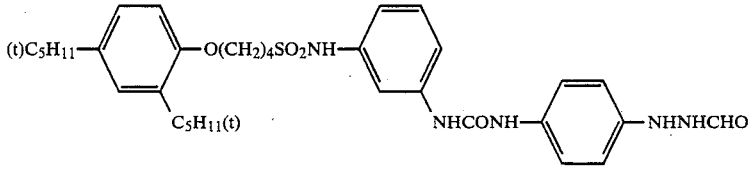
III-19
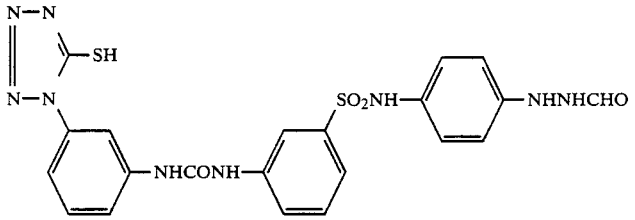
III-20
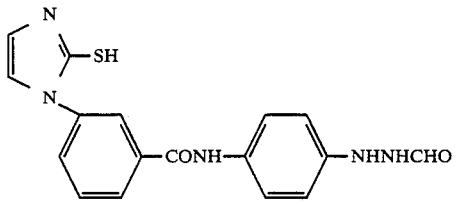
III-21
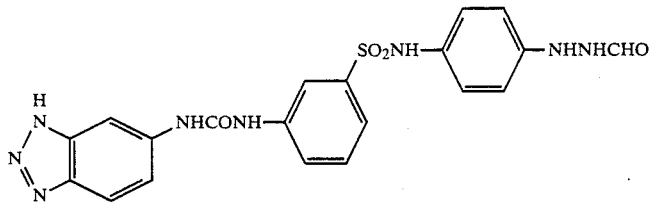
III-22
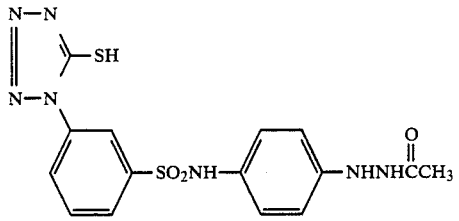
III-23
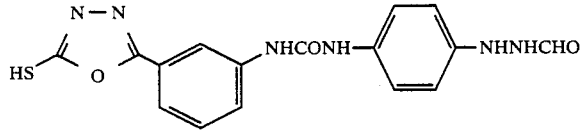

-continued

III-24

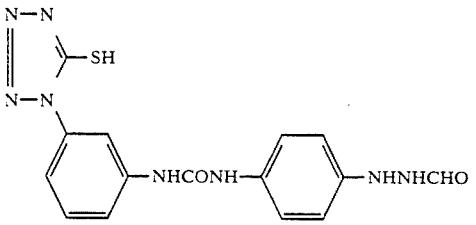

III-25

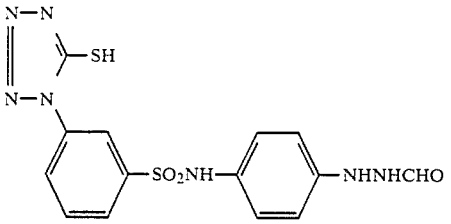

III-26

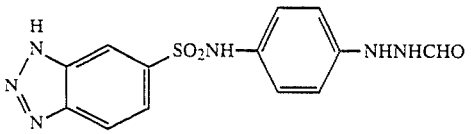

III-27

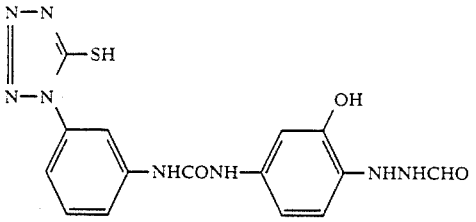

III-28

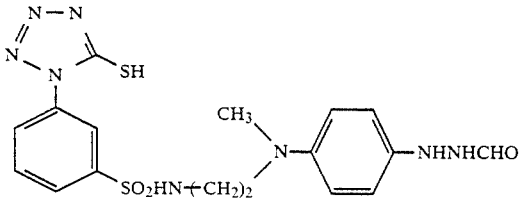

III-29

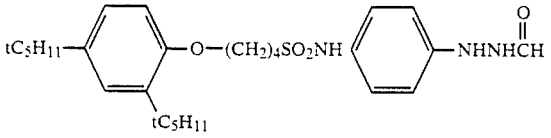

III-30

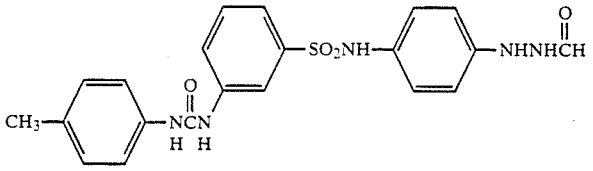

In this invention, when the compound of formula (III) described above is incorporated in the photographic light-sensitive material, it is preferred for the compound to be present in the silver halide emulsion layer thereof but the compound may be incorporated in another light insensitive hydrophilic colloid layer (e.g., protective layer, interlayer, filter layer, antihalation layer, etc.).

When the compound is water-soluble, it may be added to a hydrophilic colloid solution as an aqueous solution thereof or when is it sparingly water soluble, it may be added thereto as a solution in a water-miscible organic solvent such as alcohols, esters, ketones, etc. In the case of incorporating the compound in a silver halide emulsion layer, it may be added at any step from the initication of chemical ripening before coating but is preferably added thereto from the end of chemical ripening to coating. In particular, it is preferred to add the compound to a coating composition prepared for coating.

The optimum amount of the compound shown by formula (III) for use in this invention is desirably selected according to the grain sizes of the silver halide emulsion, the halogen composition thereof, the method and extent of the chemical sensitization therefor, the relation of the layer to which the compound is added and a silver halide emulsion layer, and the kind of the antifoggant. The test method for the selection thereof is well known in the person skilled in the art. The compound is used in the range of preferably from $1\times10^{-5}$ mol to $1\times10^{-1}$ mol, and more preferably from $1\times10^{-5}$ mol to $4\times10^{-2}$ mol per mol of silver halide.

Gelatin is advantageously used as the binder or protective colloid for the photographic emulsions, but other hydrophilic colloids can be used. For example, proteins such as gelatin derivatives, graft polymers of gelatin and other polymers, albumin, casein, etc.; cellulose derivatives such as hydroxyethyl cellulose, carboxymethyl cellulose, cellulose sulfuric acid ester, etc.; sacchride derivatives such as sodium alginate, starch derivatives, etc.; and various synthetic hydrophilic high molecular compounds such as polyvinyl alcohol, polyvinyl alcohol partial acetal, poly-N-vinylpyrrolidone, polyacrylic acid, polymethacrylic acid, polyacrylamide, polyvinyl imidazole, polyvinylpyrazole, etc., can be used.

As gelatin, limed gelatin as well as acid-treated gelatin can be used and further gelatin hydrolyzed products, gelatin enzyme-decomposition products, etc., may be used.

Suitable gelatin derivatives are those obtained by reacting gelatin and various compounds such as acid halides, acid anhydrides, isocyanates, bromoacetic acid, alkanesultones, vinylsulfonamide, maleinimides, polyalkylene oxides, epoxycompounds, etc.

As the binder, gelatin treated with an oxidizing agent (e.g., hydrogen peroxide) can be preferably used.

The silver halide emulsion which is used in the process of this invention may be or may not be spectrally sensitized but from the view point that the light-sensitive material is handled in a bright room, the emulsion is preferably not spectrally sensitized. In employing spectral sensitization, a sulfur sensitization, a reduction sensitization, a gold sensitization, or a combination thereof is usually used.

In this invention, for further improving the image quality formed, a polyalkylene compound having a molecular weight of at least 600 can be used.

The polyalkylene oxide compound for use in this invention includes a condensation product of a polyalkylene oxide composed of at least 10 alkylene oxide units having from 2 to 4 carbon atoms such as ethylene oxide, propylene-1,2-oxide, butylene-1,2-oxide, etc., and preferably ethylene oxide, with a compound having at least one active hydrogen atom, such as water, an aliphatic alcohol, an aromatic alcohol, a fatty acid, an organic amine, a hexytol derivative, etc., and a block copolymer of two or more alkylene oxides.

Specific examples of suitable polyalkylene oxide compounds are polyalkylene glycols, polyalkylene glycol alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block copolymers, and polyalkylene glycol graft polymers.

It is necessary that the molecular weight of the polyalkylene oxide compound is at least 600.

The polyalkylene oxide compound may contain not only one but also two or more polyalkylene oxide chains in the molecule. In this case, each polyalkylene oxide chain may be composed of 10 or less alkylene oxide units but the sum of the alkylene oxide units in the molecule must be at least 10. When the polyalkylene oxide compound has two or more polyalkylene oxide chains in the molecule, the alkylene oxide units may be different from each other, for example, they may be composed of ethylene oxide and propylene oxide. The polyalkylene oxide compound in this invention preferably contains from 14 to 100 alkylene oxide units.

Specific examples of the polyalkylene oxide compound (VI) for use in this invention are illustrated below:

$HO(CH_2CH_2O)_{90}H$ VI-1

$C_4H_9O(CH_2CH_2O)_{15}H$ VI-2

$C_{12}H_{25}O(CH_2CH_2O)_{15}H$ VI-3

$C_{18}H_{37}O(CH_2CH_2O)_{15}H$ VI-4

$C_{18}H_{37}O(CH_2CH_2O)_{40}H$ VI-5

$C_8H_{17}CH{=}CHC_8H_{16}O(CH_2CH_2O)_{15}H$ VI-6

VI-7

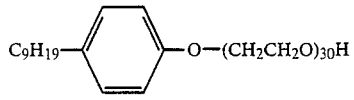

VI-8

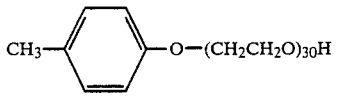

VI-9

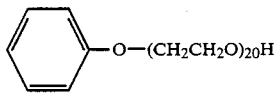

$C_{11}H_{23}COO(CH_2CH_2O)_{80}H$ VI-10

$C_{11}H_{23}COO(CH_2CH_2O)_{24}OC_{11}H_{23}$ VI-11

VI-12

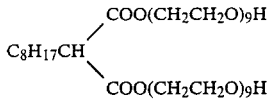

$C_{11}H_{23}CONH(CH_2CH_2O)_{15}H$ VI-13

VI-14

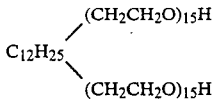

$C_{14}H_{29}N(CH_2)(CH_2CH_2O)_{24}H$ VI-15

VI-16

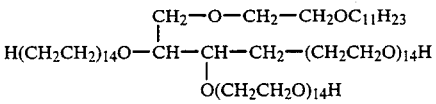

VI-17

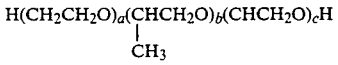

$a + b + c = 50$ $b:a + c = 10:9$

-continued

VI-18

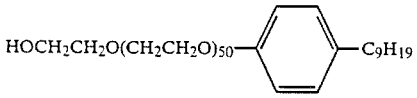

VI-19

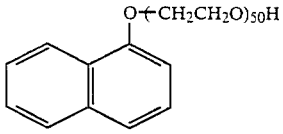

VI-20

$HO(CH_2CH_2O)_a(CH_2CH_2CH_2CH_2O)_b(C_2CH_2O)_cH$ a + c = 30, b = 14

VI-21

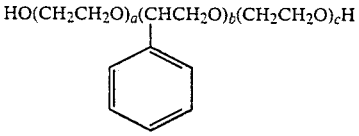

b = 8, a + c = 50

VI-22

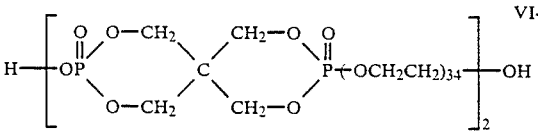

VI-23

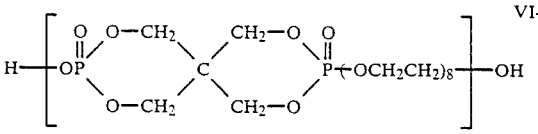

VI-24

$HO(OCH_2CH_2O)_{34}H$

These polyalkylene oxide compounds are described in JP-A-50-156423, JP-A-52-108130, and JP-A-53-3217.

These polyalkylene oxide compounds may be used alone or as a combination thereof.

In the case of adding the polyalkylene oxide compound(s) to a silver halide emulsion, they can be added to the emulsion as an aqueous solution thereof or as a solution in a low-boiling organic solvent miscible with water at an appropriate concentration before coating, and preferably after chemical ripening. Furthermore, the polyalkylene oxide compound(s) may be incorporated in a light-insensitive hydrophilic colloid layer such as in an interlayer, a protective layer, a filter layer, etc., in place of their being added to a silver halide emulsion layer.

The polyalkylene oxide compound is preferably added in the range of from $1\times10^{-5}$ mol to $1\times10^{-2}$ mol per mol of silver halide.

The light-sensitive material which is processed in this invention can contain therein various compounds for preventing the formation of fog during the production, storage, or processing of the light-sensitive material or for stabilizing the photographic performance thereof.

That is, many compounds are known as antifoggants or stabilizers, such as azoles (e.g., benzothiazolium salts, nitroindazoles, chlorobenzimidazoles, bromobenzimidazoles, mercaptothiazoles, mercaptobenzothiazoles, mercaptothiazoles, aminotriazoles, benzothiazoles, nitrobenzotriazoles, etc.), mercaptopyrimidines, mercaptotriazines, thioketo compounds (e.g., oxazolinethione), azaindenes (e.g., triazaindenes, tetraazaindenes (in particular, 4-hydroxy-substituted (1,3,3a,7)tetraazaindenes), and pentazaindenes), benzenethiosulfonic acid, benzenesulfinic acid, benzenesulfonic acid amide, etc.

In the aforesaid compounds, benzotriazoles (e.g., 5-methyl-benzotriazole) and nitroindazoles (e.g., 5-nitroindazole) are preferred. Also, the compounds capable of releasing a development inhibitor at processing described in JP-A-62-30243 can be used as the aforesaid compounds.

In particular, it has further been discovered in this invention that by using together a benzotriazole compound and/or a mercapto series compound, the quality of white lettering on solid background is further improved. Such a compound is effective only when the compound exists in the light-sensitive material. The effect is not a simple antifoging effect and not an effect of increasing the contrast in characteristics curve but an effect of improving the white lettering on a solid background. One of the compounds is a benzotriazole compound which may be substituted by at least one substituent selected from an alkyl group (e.g., methyl, ethyl, and heptyl}, an alkoxy group, a halogen atom, an acyl group, an acylamino group, a carbamoyl group, a sulfamoyl group, an aryl group, etc., and in particular, benzotriazole substituted by from 1 to 3 alkyl groups is effective. The effective addition amount thereof is in the range of from $1\times10^{-4}$ to $1\times10^{-2}$ mol, and preferably from $5\times10^{-4}$ to $5\times10^{-3}$ mol per mol of silver.

The other preferred compound which can be used in this invention for improving the quality of white lettering on a solid background is a compound represented by the following formula:

(VII)

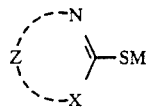

wherein M represents a hydrogen atom, $—NH_4$, or an alkali metal atom; X represents —NR (wherein R represents a hydrogen atom, an alkyl group which may be substituted, an aryl group which may be substituted, or an aralkyl group which may be substituted), a sulfur atom or an oxygen atom; and Z represents an atomic group necessary for forming a 5-membered heterocyclic ring (e.g., tetrazole, triazole, and imidazole, thiadiazole) or a 5-membered heterocyclic group condensed with a benzene ring (e.g., benzimidazole, benzothiazole, and benzoxazole). These heterocyclic rings may be substituted by a substituent such as an alkyl group, an alkoxy group, a carboxy group, a sulfo group, a hydroxy group, an amino group, a nitro group, a halogen atom, a carbamoyl group, an alkylthio group, a mercapto group, etc.

The compound shown by the aforesaid formula wherein Z is tetrazole, triazole, thiadiazole, benzimidazole, or benzothiazole is preferred and the most preferred compound is a tetrazole compound.

Specific examples of the preferred compounds shown by the aforesaid formula are illustrated below.

VII-1
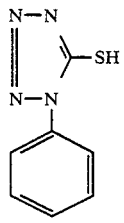
VII-2
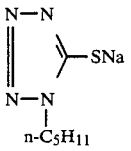
VII-3
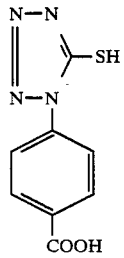
VII-4
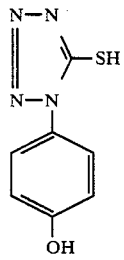
VII-5
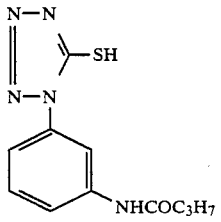
VII-6
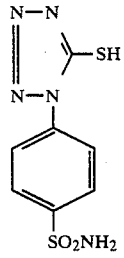
VII-7
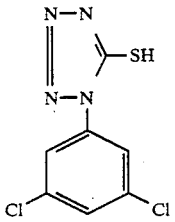
-continued
VII-8
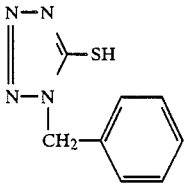
VII-9
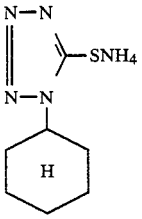
VII-10
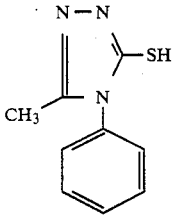
VII-11
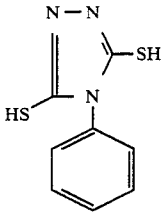
VII-12
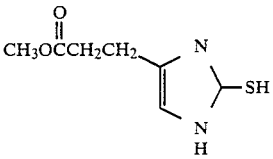
VII-13
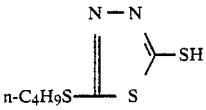
VII-14
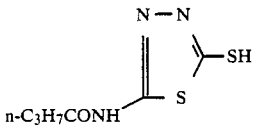
VII-15
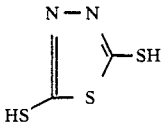

-continued

VII-16

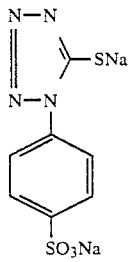

VII-17

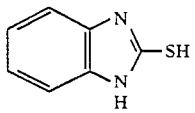

VII-18

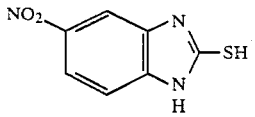

VII-19

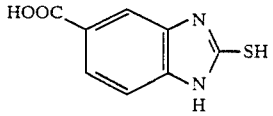

VII-20

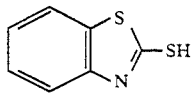

VII-21

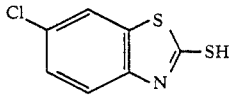

VII-22

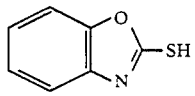

The effective addition amount of the compound is in the range of from $5\times10^{-5}$ to $5\times10^{-3}$ mol per mol of silver.

The photographic emulsions for use in this invention may contain an inorganic or organic hardening agent, such as chromium salts (chromium alum and chromium acetate), aldehydes (e.g., formaldehyde, glyoxal and glutaraldehyde), N-methylol compounds (dimethylolurea and methyloldimethylhydantoin), dioxane derivatives (e.g., 2,3-dihydroxydioxane), active vinyl compounds (e.g., 1,3,5-triacryloyl-hexahydro-s-triazine and bis(vinylsulfonyl) methyl ether and N,N'-methylenebis-[β-(vinylsulfonyl)propionamide], active halogen compounds (e.g., 2,4-dichloro-6-hydroxy-s-triazine), mucohalogenic acids (mucochloric acid and mucophenoxychloric acid), isooxazoles, dialdehyde starch, 2-chloro-6-hydroxytriazinylated gelatin.

They can be used alone or as a combination therof.

Specific examples thereof are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,363,827, 3,539,644, and 3,543,292, British Patent Nos. 676,628, 825,544, 1,270,578, German Patent Nos. 872,153 and 1,090,427, and JP-B-34-7133 and JP-B-46-1872. (The term "JP-B" as used herein means an "examined published Japanese patent application").

The photographic emulsions for use in this invention may further various surface active agents for various purposes such as a coating aid, static prevention, slidability improvement, improvement of emulsion dispersibility, adhesion prevention, and the improvement of photographic characteristics.

Examples of such surface active agents are nonionic surface active agents such as saponin (steroid series), polyalkylene glycol alkylamines, polyalkylene glycol alkylamides, polyethylene oxide addition products of silicone, glycidol derivative (e.g., alkenylsuccinic acid polyglyceride and alkylphenol polyglyceride), fatty acid esters of polyhydric alcohol, alkylesters of sugar, alkylurethanes of sugar, alkyl ethers of sugar, etc.; anionic surface active agents containing an acid group (e.g., a carboxy group, a sulfo group, a phospho group, a sulfuric acid ester group, and a phosphoric acid ester group), such as triterpenoid series saponins, alkylcarboxylates, alkylsulfonates, alkyl benzenesulfonates, alkylnaphthalenesulfonates, alkylsulfonic acid esters, alkylphosphoric acid esters, N-acyl-N-alkylurethanes, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaine, amineimines, amine oxides, etc.; and cationic surface active agents such as alkylamine salts, aliphatic or aromatic quaternary ammonium alts, heterocyclic quaternary ammonium salts (e.g., pyridiniums and imidazoliums), phosphonium salts or sulfonium salts containing an aliphatic ring or a heterocyclic ring, etc.

The photographic emulsions for use in this invention can further contain a dispersion of a water-insoluble or water sparingly soluble synthetic polymer for improving the dimensional stability. Examples of these polymers are polymers or copolymers of alkyl (meth)acrylate, alkoxyacryl (meth)acrylate, glycidyl (meth)acrylate, (meth)acrylamide, vinyl ester (e.g., vinyl acetate), acrylonitrile, olefin, styrene, etc., alone or as a combination of them, or as a combination of the aforesaid monomer and acrylic acid, methacrylic acid, α,β-unsaturated dicarboxylic acid, hydroxyalkyl (meth)acrylate, sulfoalkyl (meth)acrylate, styrenesulfonic acid, etc.

As the support for the light-sensitive material which is processed by the process of this invention, cellulose triacetate films, cellulose diacetate films, nitrocellulose films, polystyrene films, polyethylene terephthalate films, baryta-coated papers, polyethylenecoated papers, etc., can be used.

As the development accelerator or the accelerator for the nucleation infections developer, which can be suitably used for the light-sensitive material in this invention, the compounds disclosed in JP-A-53-77616, JP-A-54-37732, JP-A-53-137133, JP-A-60140340, JP-A-60-14959, etc., and also various compounds containing nitrogen atom or sulfur atom are effectively used.

Specific examples of these accelerators are illustrated below.

A-1
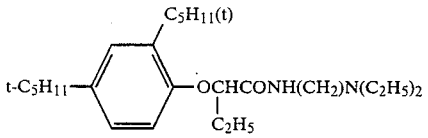
A-2
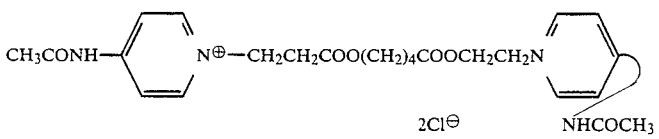
A-3
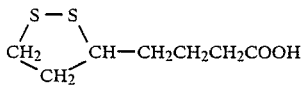
A-4
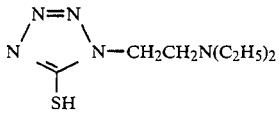
A-5
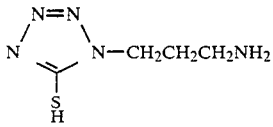
A-6
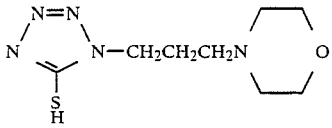
A-7
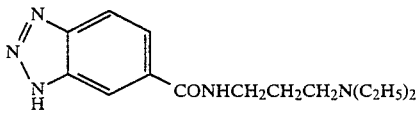
A-8
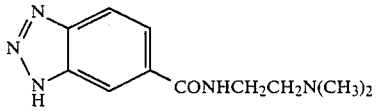
A-9
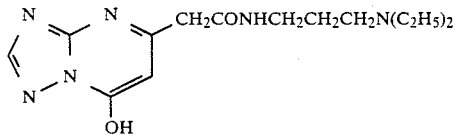
A-10
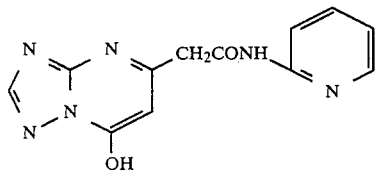
A-11
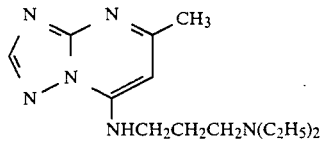

-continued

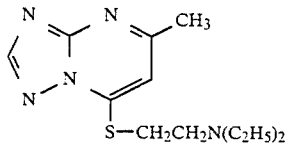

A-12

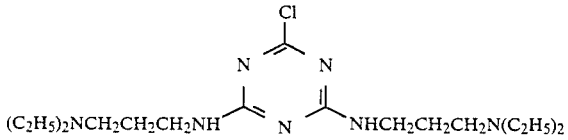

A-13

$(C_2H_5)_2NCH_2CH(OH)-CH_2OH$

A-14

$n\text{-}C_4H_9N(C_2H_4OH)_2$

A-15

The optimum addition amount of the accelerator depends upon the kind of the accelerator but is in the range of, usually from $1.0\times10^{-3}$ to 0.5 g/m$^2$, and preferably from $5.0\times10^{-3}$ to 0.1 g/m$^2$. The accelrator is added to the coating composition for the photographic layer as a solution thereof in an appropriate solvent such as water, alcohols (e.g., methanol and ethanol), acetone, dimethylformamide, methyl cellosolve, etc.

These additives may be used alone or as a mixture thereof.

Now, for obtaining super high contrast photographic characteristics using the aforesaid silver halide photographic material by the process of this invention, a stable developer can be used without heed of using a conventional infectious developer on a high-alkaline developer of about pH 13 described in U.S. Pat. No. 2,419,975.

The developer which is used in the process of this invention contains from 0.05 to 0.5 mol/liter (in particular, from 0.1 to 0.4 mol/liter) of a dihydroxybenzene as the primary developing agent and containing no subsidiary developing agent (e.g., 1-phenyl-3-pyrazolidone and p-aminophenol) or less than 0.05 g/liter of a subsidiary developing agent. Also, the developer further contains at least 0.18 mol/liter, preferably at least 0.25 mol/liter, of a free sulfite ion, at least 20 mg/liter of a compound of formula (I) described hereinbefore, and a sufficient amount of alkali for keeping the pH at least 10.5, preferably at least 11.0, and particularly preferably from 11.3 to 12.3. In this invention, it is preferred that the developer does not contain an auxiliary developing agent and contains a dihydroxybenzene (in particular, hydroquinone) as the developing agent.

The developer for use in this invention can quickly provide very high contrast photographic characteristics using the aforesaid bright room-type light-sensitive material and is very stable since it can contain a large amount of sulfite ions.

As described above, one feature of this invention is that the developer for use in this invention contains a compound shown by aforesaid formula (I).

In the preferred compound shown by formula (I), $X_1$ is a hydrogen atom or a nitro group and $X_2$ and $X_3$ each is a hydrogen atom, a methyl group, or an ethyl group. Examples of such a preferred compound are indazole, 5-nitroindazole, 6-nitroindazole, 3-methyl-5-nitroindazole, 3-methyl-6-nitroindazole, 3-methylindazole, and 3-ethyl-5-nitroindazole. In these compounds, 5-nitroindazole and 6-nitroindazole are particularly preferred.

For incorporating the compound shown by formula (I) in the developer, the compound is added thereto as a solution in water or a low-boiling organic solvent miscible with water at a proper concentration or as a solid. The content thereof is preferably from 20 mg/liter to 10 g/liter, and more preferably from 50 mg/liter to 5 g/liter.

As the developing agent which is used for the developer, there are a dihydroxybenzene series developing agent, a 1-phenyl-3-pyrazolidone series developing agent, and a p-aminophenol series developing agent and they can be used alone or as a combination thereof (e.g., a combination of a 1-phenyl-3-pyrazolidone and a dihydroxybenzene or a combination of a p-aminophenol and a dihydroxybenzene).

Also, in this invention, the light-sensitive material may be processed by a so-called infectious developer containing a sulfite ion buffer such as carbonyl bisulfite and hydroquinone.

Examples of the aforesaid dihydroxybenzene series developing agent are hydroquinone, chlorohydroquinone, bromohydroquinone, isopropylhydroquinone, toluhydroquinone, methylhydroquinone, 2,5-dimethylhydroquinone, and 2,3-dichlorohydroquinone.

Examples of the 1-phenyl-3-pyrazolidone series developing agent are 1-phenyl-3-pyrazolidone, 4,4-dimethyl-1-phenyl-3-pyrazolidone, 4-hydroxymethyl-4-methyl-1-phenyl-3-pyrazolidone, and 4,4-dihydroxymethyl-1-pyrazolidone.

Examples of the p-aminophenol series developing agent are p-aminophenol and N-methyl-p-aminophenol.

The developer contains a compound providing free sulfite ion as a precursor, such as sodium sulfite, potassium sulfite, potassium metahydrogen sulfite, sodium hydrogensulfite, etc.

Examples of alkali agent for the developer which is used in this invention are potassium hydroxide, sodium hydroxide, potassium carbonate, sodium carbonate, sodium acetate, potassium tertiary phosphate, diethanolamine, triethanolamine, etc.

The developer may also contain an organic compound known as an antifoggant or a development inhibitor. Examples of such an organic compound are azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptotetrazole)), mercaptopyrimidines, mercaptotriazines, thioketo compounds (e.g., oxazolinethione), azaindenes (e.g., triazaindenes, tetraazaindenes (in particular, 4-hydroxy-substituted (1,3,3a,7)tetraazaindenes), and pentaazaindenes), benzenethiosulfonic acid, benzene-sulfinic acid, benzenesulfonic acid amide, sodium mercaptobenzimidazole-5-sulfonate, etc.

The developer for use in this invention may further contain the compound described in JP-A-56-24347 as a silver stain preventing agent and the compound described in JP-A-62-212651, such as sodium 3-(5-mercaptotetrazole)benzenesulfonate, as a development unevenness preventing agent.

The developer described above can act quickly for a duplicated image having an excellent quality of white lettering on a solid background in the case of performing white lettering work on a solid background using the light-sensitive material described above and is very stable since the developer contains a large amount of sulfite ions.

It is preferred that the developer for use in this invention contains a polyalkylene oxide as a development inhibitor. For example, polyethylene oxide having a molecular weight of from 1,000 to 10,000 can be incorporated in the developer in the range of from 0.1 to 10 g/liter.

Also, it is preferred that the developer for use in this invention contains nitrilotiracetic acid, ethylenediaminetetraacetic acid, triethylenetetraminehexaacetic acid, diethylenetetraminepentaacetic acid, etc, as a water softener. The light-sensitive material is, after development, fixed by a fixing agent, having a conventional composition.

As a fixing agent, there are thiosulfates, thiocyanates, as well as organic sulfur compounds which are known to have an effect as a fixing agent.

The fix solution for use in this invention may contain a water-soluble aluminum salt as a hardening agent.

Furthermore, the fix solution may further contain a complex salt of ethylenediaminetetraacetic acid and tri-valent iron ion as a sulfurizing agent.

The processing temperature and the processing time can be appropriately selected but usually, the processing temperature is appropriately from 18° C. to 50° C. On the other hand, it is preferred, on processing time, to perform a quick processing of from 15 seconds to 120 seconds using a so-called automatic processor.

The invention is explained below more specifically by the following nonlimiting examples. Unless otherwise indicated, all parts, percents, ratios and the like are by weight.

COMPARISON EXAMPLE 1

Solution I: Water 600 ml, gelatin 18 g, pH 3.0.

Solution II: $AgNO_3$ 200 g, water 800 ml.

Emulsion M was prepared in the manner described below using Solution I and Solution II.

Emulsion M: Br 5 mol%, grain size 0.25 μm, Rh $1\times10^{-4}$ mol/mol-Ag

Solution III: KBr 7 g, NaCl 69 g, $NH_4RhCl_6$ 40 mg, water 800 ml.

To Solution I kept, at 42° C were simultaneously added Solution II and Solution III at definite rate over a period of 30 minutes. After removing soluble salts from the emulsion formed in a manner well known in the art, gelatin was added to the solution and, without applying chemical ripening, 2-methyl-4-hydroxy-1,3,3a,7-tetraazaindene was added thereto as a stabilizer. The mean grain size of the emulsion was 0.25 μm, the amount thereof was 1 kg, and the content of gelatin was 60 g.

To the emulsion were added 2-hydroxy-4,6-dichloro-1,3,5-triazine sodium salt as a hardening agent, $1\times10^{-4}$ mol/mol-Ag of the polyalkylene oxide compound IV-7, and $1\times10^{-3}$ mol/mol-Ag of 1-phenyl-5-mercaptotetrazole, the emulsion obtained was coated on a polyethylene terephthalate film at a silver coverage of 4.5 g/m$^2$, and then a gelatin protective layer was further coated on the emulsion layer to provide a light-sensitive material (Film M).

EXAMPLE 1

To solution (A) shown below were added aqueous silver nitrate solution (B) and aqueous sodium chloride solution (C) each shown below by a double jet method to form silver halide grains. In this case, solution (B) was added as solution $B_1$ and solution $B_2$, which were added over a period of about 4 minutes at the first half and over a period of about 8 minutes at the latter half, respectively, each at a constant flow rate. Between the first half and the latter half, a rest period of one minute was employed. Also, solution (C) was added as solution $C_1$ and solution $C_2$. By controlling the addition rates of solutions $C_1$ and $C_2$ and changing the timing of adding solutions $B_1$ and $C_1$ and solutions $B_2$ and $C_2$, the potentials at the grain formation were controlled as in the ranges shown in Table 1 below.

The potential was measured using a metallic silver electrode and a double junction type saturated calomel reference electrode.

In this case, $NH_4RhCl_6$ was added to solutions $C_1$ and $C_2$ in an amount of $1\times10^{-4}$ mol/mol-Ag.

| | | |
|---|---|---|
| Solution A | Limed gelatin | 10 g |
| | Sodium chloride | 0.2 g |
| | Water | 1000 ml |
| Solution $B_1$ | Silver nitrate | 75 g |
| | Water | 150 ml |
| Solution $B_2$ | Silver nitrate | 75 g |
| | Water | 150 ml |
| Solution $C_1$ | Sodium chloride | 27 g |
| | Water | 150 ml |
| Solution $C_2$ | Sodium chloride | 27 g |
| | Water | 150 ml |

After the formation of silver halide grains, 2-methyl-4-hydroxy-1,3,3a,7-tetraazaindene was added to the emulsion and the emulsion was allowed to stand for 10 minutes. Then, a formaldehyde condensate of sodium naphthalenesulfonate was added thereto as a flucculant and, after adjusting the pH thereto to 3.8, desalting treatment was performed twice. Thereafter, sodium hydroxide and gelatin were added thereto together with water followed by dispersing and the pH and pAg were adjusted to 6.0 and 7.2, respectively. In this case, chemical sensitization was not employed.

To the emulsion were added 2-hydroxy-4,6-dichloro-1,3,5-triazine.sodium salt as a hardening agent, $1\times10^{-4}$ mol/mol-Ag of the polyalkylene oxide compound IV-7, and $1\times10^{-3}$ mol/mol-Ag of 1-phenyl-5-mercaptotetrazole, and then the emulsion obtained was coated on a polyethylene terephthalate film at a silver coverage of 3.0 g/m$^2$. Also, a gelatin protective layer was further formed on the emulsion layer. Thus, light-sensitive material (Films A to F) were prepared.

TABLE 1

| Emulsion No. | Potential at Grain Formation First Half | Latter Half | Grain Size (μm) | Film |
|---|---|---|---|---|
| I-a | 50 to 80 mV | 80 to 350 mV | 0.17 | A |
| I-b | 70 to 150 mV | " | 0.15 | B |
| I-c | 80 to 250 mV | " | 0.13 | C |
| I-d | 250 to 350 mV | " | 0.09 | D |
| I-e | 350 to 450 mV | " | 0.07 | E |
| I-f | 450 to 500 mV | " | 0.07 | F |

Then, after exposing each sample film by a printer Type P-607, made by Dainippon Screen Mfg. Co., Ltd., using an original having the construction shown in FIG. 1, the sample was processed in an automatic processor, FG-25L (made by Fuji Photo Film Co., Ltd.) containing a lith developer HS-1 (made by Fuji Photo Film Co., Ltd.) for an optimum development time (1 min. 40 sec. at 27° C.). Apart from this, each sample image exposed was also processed in an automatic processor, FG-25 RA (made by Fuji Photo Film Co., Ltd.) containing Developer I described below for an optimum time (20 seconds at 38° C.).

| Developer I | |
|---|---|
| Potassium bromide | 2.0 g |
| Potassium hydroxide | 20 g |
| Potassium carbonate | 35 g |
| Potassium sulfite | 80 g |
| Hydroquinone | 20 g |
| Triethylene glycol | 30 g |
| Polyethylene glycol (molecular weight 4,000) | 2.0 g |
| 5-Nitroindazole | 0.1 g |
| Water to make | 1 liter |
| pH | 11.7 |

The results obtained are shown in Table 2.

In Table 2, the quality 5 of white lettering on a solid background is an image quality of white letters having a width of 30 μm reproduced when an appropriate exposure is applied such that a dot image area of 50% is formed as a dot image area of 50% on the light-sensitive material for duplication using the original shown in FIG. 1, which is very good quality lettering on a solid background. On the other hand, the quality 1 of white lettering on a solid background is an image capable of reproducing letters having a width of thicker than 150 μm only when the similar optimum exposure is applied, which is a bad quality of white lettering on a background. Between the qualities 5 and 1, ranks 2 to 4 are formed by functional evaluation. Quality 2 and higher are practical usable levels.

TABLE 2

| Film | Halogen Composition (AgCl) | Grain Size (μm) | Quality of White Lettering on Solid Background: Lith Developer | Developer I |
|---|---|---|---|---|
| A | 100% | 0.17 | 1 | 2 |
| B | " | 0.15 | 2 | 3.5 |
| C | " | 0.13 | 3 | 4 |
| D | " | 0.09 | 4 | 5 |
| E | " | 0.07 | 4 | 5 |
| F | " | 0.07 | 4 | 5 |
| G | 95% | 0.25 | 1 | 2 |

Films A and G: Comparison Samples;
Films B to F: Samples of this Invention

As is clear from the results shown in Table 2, it can be seen that when the grain sizes become less than 0.15 μm, the level of the quality of white lettering on solid background is improved.

EXAMPLE 2

By following the same procedure as Example 1 except that the halogen compositions for Emulsions 1-b, 1-d, and 1-e were changed as Emulsions B, D, and E shown in Table 3 below, Films B-1 to B-5, D-1 to D-4, and E-1 and E-4 were prepared.

The samples were evaluated as in Example 1.

The results obtained are shown in Table 3.

TABLE 3

| Film | Halogen Composition (AgCl) | Grain Size (μm) | Quality of White Lettering on Solid Background: Lith Developer | Developer I |
|---|---|---|---|---|
| B-1 | 100% | 0.15 | 1.5 | 3.5 |
| B-2 | 96% | " | 1.5 | 3.5 |
| B-3 | 90% | " | 1 | 3 |
| B-4 | 80% | " | 1 | 3 |
| B-5 | 75% | " | 1 | 1 |
| D-1 | 100% | 0.09 | 3 | 5 |
| D-2 | 96% | " | 2 | 4 |
| D-3 | 80% | " | 1 | 3 |
| D-4 | 75% | " | 1 | 2 |
| E-1 | 100% | 0.07 | 3 | 5 |
| E-2 | 96% | " | 3 | 5 |
| E-3 | 80% | " | 2 | 3 |
| E-4 | 75% | " | 1 | 2 |

Films B-5, D-4, and E-4 are comparison samples and the other films are samples of this invention.

As is clear from the above results, halogen compositions of more than 80 mol % silver chloride show good performance and compositions of more than 96 mol % silver chloride show better results.

EXAMPLE 3

To an aqueous gelatin solution kept at 35° C. were simultaneously added an aqueous silver nitrate solution and an aqueous sodium chloride solution containing $1\times10^{-4}$ mol of $(NH_4)_3RhCl_6$ over a period of 10 minutes while controlling the potential at 200 mV to provide a monodispersed cubic grain silver chloride emulsion having a mean grain size of 0.10 μm. After removing soluble salts therefrom in a conventional manner, gelatin was added to the emulsion. (primitive emulsion).

To the emulsion was added the hydrazine compound as shown in Table 5 below. Then, 50 mg/m$^2$ of a nucleation accelerator (1) shown below, 30 mg/m$^2$ of a dye (2) shown below, 10 mg/m$^2$ of 1-phenyl-5-mercaptotetrazole, and a polyethyl acrylate latex (30% by weight as solid to gelatin) were added to the emulsion and after adding thereto 1,3-divinylsulfonyl-2-propanol, the emulsion was coated on a polyester film support at a silver coverage of 3.8 g/m$^2$. The gelatin coverage was 1.8 g/m$^2$. On the emulsion layer was simultaneously coated a layer containing 1.5 g/m$^2$ of gelatin, 50 mg/m$^2$ of polymethyl methacrylate particles having particle size of 2.0 μm, sodium dodecylbenzenesulfonate, and a compound having the structural formula (3) shown below. Thus, light-sensitive materials (Samples 1 to 12) shown in Table 5 below were prepared.

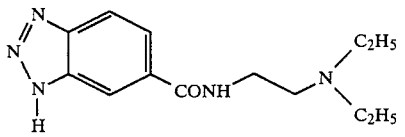

(1)

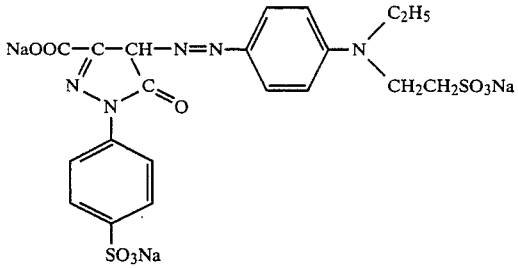

(2)

$$n\text{-}C_8F_{17}SO_2\underset{\underset{C_3H_7}{|}}{N}CH_2COOK \quad (3)$$

Each of the samples thus obtained was exposed through an optical wedge by a bright room-type printer, P607, made by Dainippon Screen Mfg., Co., developed with the developer shown in Table 4 below, fixed, washed and dried using an automatic processor, FG-660F (made by Fuji Photo Film Co., Ltd.). The results obtained are shown in Table 5 below.

(gamma): $(3.0-0.3)/-\{\log(A)-\log(B)\}$ (A): Exposure amount providing a density of 0.3

(B): Exposure amount providing a density of 3.0

Quality of white lettering on a solid background:

As described in JP-A-58-190943, a laminate composed of a base film, a film having line positive images (line image original), a base film, and a film having dot images (dot image original) in this order was superposed on each sample so that the dot original was in contact with the protective layer, an appropriate exposure was applied thereto such that a dot area of 50% was formed on the film sample as a dot area of 50%, and the sample was processed as described above. In this case, the quality capable of reproducing letters of 30 μm width of the line original was defined as rank 5, the quality of reproducing letters of 150 μm or thicker in width only was defined as rank 1, and ranks 2, 3, and 4 were formed between ranks 5 and 1 by functional evaluation. Rank 2 or higher are practical usable level.

As is clear from the results shown in Table 5, it can be seen that the Test Nos. 2 and 8 in this invention give good quality of white lettering on a solid background and the developer was stable to air oxidation.

While the invention has been described in detail and with reference to specific embodiments thereof, it will be apparent to one skilled in the art that various changes and modifications can be made therein without departing from the spirit and scope thereof.

TABLE 4

| | Developer | | | | | |
|---|---|---|---|---|---|---|
| | A | B | C | D | E | F |
| Ethylenediaminetetraacetic acid tetra-sodium | 2.0 g | 2.0 g | 2.0 g | 2.0 g | 2.0 g | 2.0 g |
| Potassium bromide | 2.0 g | " | " | " | " | " |
| Potassium hydroxide | 8.0 g | 20.0 g | 20.0 g | 20.0 g | 8.0 g | 20.0 g |
| Potassium carbonate | 35.0 g | 35.0 g | 35.0 g | 35.0 g | 35.0 g | 35.0 g |
| Formaldehyde sodium hydrogensulfite | — | — | — | — | — | — |
| Potassium sulfite | 80.0 g | 80.0 g | 80.0 g | 5.0 g | 80.0 g | 80.0 g |
| 1-Phenyl-3-pyrazolidone | 0.2 g | — | 0.2 g | — | — | — |
| Hydroquinone | 20.0 g | 20.0 g | 20.0 g | 20.0 g | 20.0 g | 20.0 g |
| Triethylene glycol | 30.0 g | 30.0 g | 30.0 g | 30.0 g | 30.0 g | 30.0 g |
| Polyethylene glycol (mol. unit 3,000) | 2.0 g | 2.0 g | 2.0 g | 2.0 g | 2.0 g | 2.0 g |
| 5-Nitroindazole | 0.1 g | 0.1 g | 0.1 g | 0.1 g | 0.1 g | 0.1 g |
| 5-Methylbenzotriazole | 0.1 g | " | " | " | " | " |
| Water to make | 1 l | 1 l | 1 l | 1 l | 1 l | 1 l |
| pH adjusted by NaOH | 10.5 | 11.6 | 11.6 | 11.6 | 11.6 | 11.6 |

TABLE 5

| | Hydrazine compound | | | Performance 1* | | Performance 2* | |
|---|---|---|---|---|---|---|---|
| Sample No. | Kind | Amount mol/mol-Ag | Developer | Y | Quality of White Lettering on solid Background | Y | Quality of White Lettering on solid Background |
| 1 | III-18 | $4 \times 10^{-3}$ | A | 5.6 | 1 | 5.4 | 1 |
| 2 | " | " | B | 16.0 | 4.5 | 14.9 | 4 |
| 3 | " | " | C | 11.2 | 2.5 | 11.0 | 2.5 |
| 4 | " | " | D | 16.8 | 4.5 | 11.2 | 3 |
| 5 | " | " | E | 7.0 | 1 | 6.8 | 1 |
| 6 | " | " | F | 10.2 | 2.5 | 10.0 | 2.5 |
| 7 | III-25 | $1 \times 10^{-3}$ | A | 6.0 | 1 | 6.1 | 1 |
| 8 | " | " | B | 15.1 | 4 | 15.2 | 4 |
| 9 | " | " | C | 12.0 | 2.5 | 11.5 | 2.5 |
| 10 | " | " | D | 16.1 | 4.5 | 10.9 | 2.5 |
| 11 | III-25 | $1 \times 10^{-3}$ | E | 7.0 | 1 | 7.0 | 1 |
| 12 | " | " | F | 10.9 | 2 | 10.0 | 2 |

1* The developer (A to F) immediately after preparation was used.
2* The developer (A to F) was used after allowing it to stand for 7 days after the preparations.
Samples 2 and 8 are samples of this invention and the other samples are comparison samples.

In the above table:

What is claimed is:

1. An image-forming process which comprises developing an imagewise exposed silver halide photographic material comprising a support having thereon at least one silver halide emulsion layer composed of silver halide grains comprising more than 90 mol % silver chloride and containing at least $1\times10^{-6}$ mol of a rhodium salt per mol of silver and having a mean grain size of not larger than 0.15 μm with a developer meeting the following conditions (a) to (d);

(a) the developer substantially contains only a dihydroxybenzene as the developing agent, (b) the developer contains at least 0.18 mol/liter of free sulfite;

(c) the pH of the developer is at least 10.5, and (d) the developer contains at least 20 mg/liter of a compound represented by formula (I):

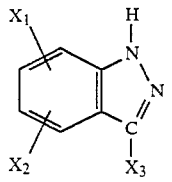

(I)

wherein $X_1$ represents a hydrogen atom or a nitro group and $X_2$ and $X_3$ each represents a hydrogen atom or an alkyl group having from 1 to 4 carbon atoms.

2. The image-forming process as claimed in claim 1, wherein the silver halide photographic material contains a hydrazine derivative in the silver halide emulsion layer or another hydrophilic colloid layer formed on the support.

3. The image-forming process as claimed in claim 2, wherein the pH of the developer is at least 11.0.

4. The image-forming process as claimed in claim 1, wherein the compound shown by formula (I) is 5-or 6 nitroindazole.

5. The image-forming process as claimed in claim 4, wherein the developer contains from 0.05 to 0.5 mol/liter of a dihydroxybenzene developing agent, from 0 to 0.05 g/liter of an auxiliary developing agent, and at least 0.25 mol/liter of free sulfite ion.

6. The image-forming process as claimed in claim 1, wherein the silver halide grains are prepared in the presence of a tetraazaindene compound of the formula (II)

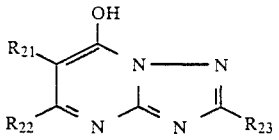

(II)

wherein $R_{21}$, $R_{22}$, and $R_{23}$ each represents a hydrogen atom, an alkyl group, an amino group, a derivative of an alkyl group, a derivative of an amino group, a halogen atom, an aryl group, a derivative of an aryl group or —CONH—$R_{24}$, wherein $R_{24}$ represents a hydrogen atom, an alkyl group, an amino group, a derivative of an alkyl group, a derivative of an amino group, a halogen atom, an aryl group, or a derivative of an aryl group.

7. The image-forming process as claimed in claim 1, wherein the silver halide emulsion layer or another hydrophilic colloid layer contains a hydrazine compound.

8. The image-forming process as claimed in claim 1, wherein the silver halide photographic material contains a compound represented by the formula (VII)

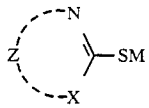

(VII)

wherein M represents a hydrogen atom, —$NH_4$, or an alkali metal atom; X represents a sulfur atom, an oxygen atom, or —NR wherein R represents a hydrogen atom, an alkyl group which may be substituted, an aryl group which may be substituted or an aralkyl group which may be substituted; and Z represents an atomic group necessary for forming a 5-membered heterocyclic ring or a 5-membered heterocyclic group condensed with a benzene ring.

9. The image-forming process as claimed in claim 1, wherein the dihydroxybenzene is present in an amount of from 0.05 to 0.5 mol/liter.

10. The image-forming process as claimed in claim 1, wherein said compound represented by formula (I) is indazole, 5-nitroindazole, 6-nitroindazole, 3-methyl-5-nitroindazole, 3-methyl-6-nitroindazole, 3-methylindazole, or 3-ethyl-5-nitroindazole.

11. The image-forming process as claimed in claim 1, wherein the dihydroxy benzene is hydroquinone, chlorohydroquinone, bromohydroquinone, isopropylhydroquinone, toluhydroquinone, methylhydroquinone, 2,5-dimethylhydroquinone or 2,3-dichlorohydroquinone.

12. The image-forming process as claimed in claim 1, wherein said silver halide grains comprise more than 96 mol % silver chloride.

13. The image-forming process as claimed in claim 2, wherein said hydrazine derivative is represented by the formula (III)

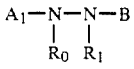

(III)

wherein $A_1$ represents an aliphatic group or an aromatic group;

B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfinyl group, a thioacyl group, a thiocarbamoyl group, a sulfamoyl group, a carbamoylcarbonyl group, an oxycarbonylcarbonyl group, or a heterocyclic group; and $R_0$ and $R_1$ both represent a hydrogen atom or one of $R_0$ and $R_1$ represents a hydrogen atom and the other represents a substituted or unsubstituted alkylsulfonyl group, a substituted or unsubstituted arylsulfonyl group, or a substituted or unsubstituted acyl group; and B, $R_1$ and the nitrogen atom bonded thereto may form a partial structure

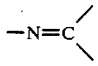

of hydrazone.

14. The image-forming process as claimed in claim 2, wherein said hydrazine derivative is represented by the formula (IV)

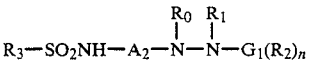

(IV)

wherein $G_1$ represents a carbonyl group, a sulfonyl group, a sulfoxy group, a phospho group, or an iminomethylene group;

$R_2$ represents a hydrogen atom, an alkyl group, an aryl group, an alkoxy group, an aryloxy group, an amino group, a carbamoyl group, or an oxycarbonyl group;

$A_2$ represents a phenylene group or a naphthylene group;

$R_3$ represents an aliphatic group, an aromatic group, or a heterocyclic group;

n represents 1 or 2; and $R_0$ and $R_1$ both represent a hydrogen atom or one of $R_0$ and $R_1$ represents a hydrogen atom and the other represents a substituted or unsubstituted alkylsulfonyl group, a substituted or unsubstituted arylsulfonyl group, or a substituted or unsubstituted acyl group, with the proviso that at least one of said $R_2$, $R_3$, and $A_2$ has a ballast group or a group accelerating adsorption onto silver halide.

* * * * *